US009546843B2

(12) United States Patent
Sroufe et al.

(10) Patent No.: US 9,546,843 B2
(45) **Date of Patent: *Jan. 17, 2017**

(54) EXTENDABLE SLIDE MEMBER FOR PISTOL SLIDE

(71) Applicant: Taurus International Manufacturing, Inc., Miami, FL (US)

(72) Inventors: Dustin Sroufe, Hollywood, FL (US); Joseph Wall, Fort Lauderdale, FL (US); Jesse Peyton, Plantation, FL (US); Nelson Mercado, North Miami Beach, FL (US); Mark Kresser, Miramar, FL (US)

(73) Assignee: Taurus International Manufacturing, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/971,408

(22) Filed: Dec. 16, 2015

(65) Prior Publication Data

US 2016/0102938 A1 Apr. 14, 2016

Related U.S. Application Data

(63) Continuation-in-part of application No. 14/073,099, filed on Nov. 6, 2013, now Pat. No. 9,239,207.

(51) Int. Cl.

| | |
|---|---|
| ***F41A 1/08*** | (2006.01) |
| ***F41C 3/00*** | (2006.01) |
| ***F41A 3/72*** | (2006.01) |

(52) U.S. Cl.
CPC .. *F41C 3/00* (2013.01); *F41A 3/72* (2013.01)

(58) Field of Classification Search
CPC ..... F41C 3/00; F41A 3/72
USPC ... 89/1.4, 1.14, 196, 147; 42/71.02, 90, 106, 42/16
See application file for complete search history.

(56) References Cited

U.S. PATENT DOCUMENTS

| | | | | |
|---|---|---|---|---|
| 885,436 | A | 4/1908 | Clement | |
| 1,187,888 | A | 6/1916 | Diehm | |
| 1,226,478 | A | 5/1917 | Diehm | |
| 1,290,855 | A | 1/1919 | Wesson | |
| 1,680,186 | A | 4/1924 | Frommer | |
| 2,744,448 | A * | 5/1956 | Allen | F41A 3/54 42/69.03 |
| 5,050,481 | A | 9/1991 | Knight, Jr. et al. | |
| 5,275,084 | A | 1/1994 | Ruger | |
| 6,561,073 | B1 * | 5/2003 | Høgmoe | F41C 33/0281 89/1.4 |
| 7,451,683 | B2 | 11/2008 | Kellermann et al. | |
| 8,015,741 | B2 * | 9/2011 | Hooks | F41A 17/46 42/70.01 |
| 8,191,301 | B2 * | 6/2012 | Hatfield | F41A 19/34 42/90 |

(Continued)

*Primary Examiner* — Michelle R Clement
(74) *Attorney, Agent, or Firm* — Robert Curcio; DeLio, Peterson & Curcio, LLC

(57) ABSTRACT

An extendable slide member on a pistol slide action, providing leverage and a gripping base for a user to pull back or "rack" the slide along guides on a pistol frame, in a longitudinal motion relative to the pistol frame. The slide member facilitating racking the slide when in an extended position the slide member rotates either laterally outwards from a side surface of the slide or vertically upwards from a top surface of the slide, and presents a gripping or holding segment for the user to pull the slide towards the breech end of the pistol.

20 Claims, 25 Drawing Sheets

(56) References Cited

U.S. PATENT DOCUMENTS 8,312,803 B2 * 11/2012 Oz ..... F41A 19/34 42/71.02
8,438,774 B2 * 5/2013 Sharp ..... F41C 33/0281 42/90
8,448,373 B2 * 5/2013 Matthews ..... F41A 33/00 42/114
8,468,734 B2 * 6/2013 Meller ..... F41A 3/72 42/71.02
8,549,785 B2 * 10/2013 Sharp ..... F41C 33/0281 42/90
8,650,794 B2 * 2/2014 Swan ..... F41C 23/02 42/106
8,887,432 B2 * 11/2014 Oz ..... F41A 35/06 42/71.01
9,121,662 B1 * 9/2015 Love ..... F41C 27/00
9,157,691 B2 * 10/2015 Parnell ..... F41A 7/00
9,194,636 B2 * 11/2015 McAninch ..... F41A 7/00
9,194,654 B1 * 11/2015 Viani ..... F41C 27/00
9,239,207 B2 * 1/2016 Kresser ..... F41A 3/72
9,267,759 B2 * 2/2016 Speroni ..... F41C 27/00
9,291,413 B1 * 3/2016 Viani ..... F41A 3/72
9,297,613 B2 * 3/2016 Maentymaa ..... F41G 1/00
9,328,991 B2 * 5/2016 Gale ..... F41C 27/00
2004/0200109 A1 * 10/2004 Vasquez ..... F41A 19/01 42/1.01
2011/0010978 A1 1/2011 Hooks
2011/0088539 A1 4/2011 Oz
2011/0107644 A1 * 5/2011 Faifer ..... F41C 23/04 42/75.02
2011/0154710 A1 6/2011 Hatfield
2011/0283587 A1 * 11/2011 Sharp ..... F41C 33/0281 42/90
2012/0198744 A1 8/2012 Meller et al.
2013/0061737 A1 3/2013 Brown
2013/0081318 A1 * 4/2013 Morando ..... F41A 35/00 42/108
2013/0111799 A1 * 5/2013 Lee ..... F41G 11/001 42/106
2013/0255478 A1 * 10/2013 McAninch ..... F41A 7/00 89/1.4
2013/0327798 A1 * 12/2013 Lee ..... F41C 33/008 224/183
2014/0047753 A1 * 2/2014 Grossman ..... F41A 3/66 42/72
2014/0150325 A1 * 6/2014 Keng ..... F41G 11/003 42/118
2014/0298703 A1 * 10/2014 Gale ..... F41C 27/00 42/71.02

* cited by examiner

EXTENDABLE SLIDE MEMBER FOR PISTOL SLIDE

BACKGROUND OF THE INVENTION

1. Field of the Invention

The present invention relates to semi-automatic firearms. Particularly it concerns hand-held pistols or repeating handguns having a slide action mechanism. More particularly, the present invention relates to facilitating the pulling or "racking" of a pistol slide using an extendable slide member on the slide action.

2. Description of Related Art

Conventionally designed pistols generally have a breech in the form of an exposed slide, which is movably arranged on a frame in the longitudinal direction, that is, in the direction along the length of the barrel. The frame, consisting of metal or plastic, serves to hold the mechanical parts of the firearm, such as the trigger housing and bolt carrier group. The frame includes a grip portion that receives the magazine. The frame provides support for the control and guide elements for the slide.

The slide is the part of the weapon on a majority of semi-automatic pistols that moves during the operating cycle and generally houses the firing pin or striker and the extractor, and serves as the bolt. A bolt is a mechanical part of a firearm that blocks the rear of the chamber while the propellant burns, but moves out of the way to allow another cartridge or shell to be inserted in the chamber.

In an automatic or semi-automatic firearm, the bolt cycles back and forward between each shot, propelled by recoil or expanding gas (back) or the recoil spring (forward). When it moves back, an extractor pulls the spent casing from the chamber. When it moves forward, it strips a cartridge from the magazine and pushes it into the chamber. Once the cartridge case is clear of the chamber, the ejector kicks the case out of the weapon. The extractor and firing pin are often integral parts of the bolt. The slide of a semi-automatic pistol is a form of bolt. It is spring-loaded so that once it has moved to its rearmost position in the firing cycle, spring tension brings it back to the starting position chambering afresh cartridge during the motion, provided that the magazine is not empty.

The majority of semi-automatic pistols in use are essentially of the single action type in which a firing pin, typically impacted by a hammer, is cocked into firing position by recoil of the slide when the weapon is discharged by the pull of the trigger. Some of these weapons may be double action on loading of the first round, but single action thereafter for all rounds in the magazine, and thus, are not double action only weapons.

Operation of a semi-automatic pistol requires one to first load bullets into a magazine. Next, a magazine is inserted into the pistol, usually within the pistol grip portion. A magazine is an ammunition storage and feeding device within or attached to a repeating firearm, such as a semi-automatic pistol. Magazines may be integral to the firearm (fixed) or removable (detachable). The magazine functions by moving the cartridges stored in the magazine into a position where they may be loaded into the chamber by the action of the firearm. The slide is pulled back and released, which serves to load the cartridge or round into the chamber and cocks the hammer. The function of the hammer is to strike the firing pin, which in turn detonates the impact-sensitive cartridge primer. With each trigger pull, a round is fired and a new one is automatically loaded, ready for another trigger pull.

In order to fire a double action pistol, the magazine is first loaded, the slide is then pulled back or "racked", and a cartridge or round is placed in the chamber. Firing is then initiated by pulling the trigger. The trigger pull is cocking the hammer first. Then after it fires, the pistol will load afresh round in and cock the hammer, so the second trigger pull is much shorter and lighter.

In a striker fire pistol, a striker is similar to a firing-pin with the exception of a spring being located in back of the striker and forcing it to the front. When the pistol is cocked a sear holds the striker in a rearward position. When the pistol is fired the sear releases the striker, which flies forward under the impetus of its spring and strikes the primer.

In a double-action striker-fired pistol, when the slide is racked, the striker is latched back far enough to be clear of the breech face when feeding a round into the chamber, but not far enough to fire the pistol if released. When the trigger is pulled, the striker is pulled back farther, and then released.

It is sometimes difficult for some people to pull or "rack" the slide on pistols, due to weak hand strength, grip, age, and/or related medical conditions, like arthritis or joint tenderness. New shooters are sometimes too gentle with a pistol and are afraid of slide "bite" to definitively and aggressively rack the slide as they should. It is understood, however, that shooters cannot operate a semi-automatic pistol efficiently for loading, unloading, and clearing malfunctions without racking the slide properly and quickly. Thus, there remains a need in the art for facilitating proper racking of the slide on a pistol.

Racking the slide simply means manipulating and moving the slide back and forth on its guide rails. There are many ways and considerations for racking the slide. Even some experienced competitors have demonstrated that they cannot optimally rack the slide to perform reloads. Others have concluded that they have no choice but to use a revolver, rather than a semi-automatic pistol, especially for concealed carry purposes, because they cannot rack the slide. Consequently, racking the slide is a prevalent issue in pistol ownership and shooting, and the user must be confident to perform this function effectively.

Two common methods for racking the slide are the "sling shot" method and the "over-the-top" method. For the sling shot method, the thumb and index finger of the support hand are in a "V" position to grasp or pinch the back of the slide on the slide grip portion, which is generally a serrated section of the breech end of the slide, and quickly pull the slide to the rear, not unlike shooting a slingshot. A length of the slide is pinched and grasped for better control. Concurrently with the grasping of the slide with the support hand, the strong hand is quickly pushed forward away from the shooters body. Throughout this action, the grasped slide must be tightly held.

In the over-the-top method, the shooter's support hand is used to grasp the rear slide serrations over the top of the slide. For a right-handed shooter, the heel of the support hand rests on the left-side serrations, while the outside, right-side serrations, are grasped with the four fingers of the support hand. This method yields a more powerful grip on the slide because more fingers and the heel of the support hand are used for added strength. Again, throughout this action, the grasped slide must be tightly held.

Moreover, the slide must be moved back to a lock position in order to insert a new loaded magazine, for cleaning purposes, or to insert a new magazine when a magazine follower automatically locks the slide back when the spent magazine becomes empty. To lock the slide to the rear, the slide stop lever is pushed up as the slide is racked backwards by the support hand, and before it travels forward. Many shooters will shift their strong grip hand around to the left (for a right-handed shooter) so they can lift up the slide stop lever with their strong-hand thumb.

It is apparent from these methods that proper technique and a strong grip are required to rack the slide. Older shooters, shooters with certain medical conditions, weaker shooters, younger shooters, and others with difficulty racking the slide would benefit from an easier way to reduce the grasping force while securing the grip.

SUMMARY OF THE INVENTION

Bearing in mind the problems and deficiencies of the prior art, it is therefore an object of the present invention to provide a pistol slide that allows a user to more easily and efficiently pull or rack the slide back.

It is another object of the present invention to provide a modified pistol slide to facilitate racking.

It is a further object of the present invention to incorporate an extendable member on a pistol slide that enables a user to establish a firm grip for pulling the slide in relation to the pistol frame.

The above and other objects, which will be apparent to those skilled in the art, are achieved in the present invention which is directed to a pistol slide having a top surface facing upwards when the pistol is held in an upright firing position, side surfaces adjacent the top surface and facing outwards left and right in a direction perpendicular to the top surface, a breech end, and a muzzle end opposite the breech end, the slide including: at least one partially walled aperture located proximate the breech end of the slide having an opening accessible from the slide top surface or the slide side surface, or both; at least one extendable, retractable slide member, the slide member extendable approximately laterally outwards from the side surface in a direction approximately perpendicular to the top surface when the slide member is in an extended position, the slide member including: a top edge, a holding portion, and an attachment segment, the attachment segment being insertable within the at least one partially walled aperture for rotatably attaching to the slide; and a resilient bias member providing a restoring force to the at least one slide member when the at least one slide member is extended laterally outwards, the restoring force acts to retract the at least one slide member laterally inwards towards the slide side surface.

The slide includes: a receiving slot in at least one side of the slide to receive the slide member holding portion when the slide member is in its fully retracted or closed position; and a sloped indent located on at least one side of the slide top surface, and extending in a sloping fashion from a point proximate a center of the slide top surface toward the slide side surface to a position below the slide member top edge.

The slide member is approximately flush-mounted with the side surface of the slide when the at least one slide member is in a retracted position within the receiving slot.

The receiving slot is indented within the slide side surface, the receiving slot formed by a bottom surface, a breech end side wall, and a muzzle end side wall, such that the slide member is received within the receiving slot. A top segment extends from the slide side surface and the breech end side wall of the receiving slot form the at least one partially walled aperture. The attachment segment comprises an approximate cylindrically shaped column for rotatably attaching to the slide at the partially walled aperture.

The partially walled aperture extends circumferentially more than 180° about the approximate cylindrically shaped column of the attachment segment, securing the attachment segment within the partially walled aperture while simultaneously allowing the attachment segment to rotate relative to the slide.

The pistol slide further includes: an aperture within the slide accessible from the slide breech end and extending to the receiving slot; the resilient bias member insertably supportable within the aperture, forming a biased detent for the attachment segment; and a plunger biased by the resilient bias member insertably supportable within the aperture and slideably movable within the aperture toward the slide muzzle end to a position where the plunger is exposed to the receiving slot.

The attachment segment includes a notch having a mating surface; and the plunger includes a complementary mating surface in contact with the attachment segment mating surface. The attachment segment mating surface and the plunger complementary mating surface, when in contact, cause the plunger and resilient bias member combination to move in an axial direction parallel to the slide side surface when the slide member is rotated outwards, away from the slide, which provides the restoring force to the slide member. The plunger includes a peg extending radially therefrom for assembling a side member/plunger/resilient bias member combination within the slide, the peg insertable within a slot located within a bottom portion of the attachment segment.

In a second aspect, the present invention is directed to a pistol comprising: a frame for holding mechanical parts of the pistol, including a trigger housing and a bolt carrier group, the frame further includes a grip portion that receives a magazine; a slide, longitudinally slidable with respect to the frame, the slide housing a firing pin or striker of the pistol and an extractor, the slide serves as a bolt for the pistol, the slide having a top surface facing upwards when the pistol is held in an upright firing position, side surfaces adjacent the top surface and facing outwards left and right in a direction perpendicular to the top surface, a breech end, and a muzzle end opposite the breech end, the slide including: at least one partially walled aperture located proximate the breech end of the slide having an opening accessible from the slide top surface or the slide side surface, or both; at least one extendable, retractable slide member, the slide member extendable approximately laterally outwards from the side surface in a direction approximately perpendicular to the top surface when the slide member is in an extended position, the slide member including: a top edge, a holding portion, and an attachment segment, the attachment segment being insertable within the at least one partially walled aperture for rotatably attaching to the slide; and a resilient bias member providing a restoring force to the at least one slide member when the at least one slide member is extended laterally outwards, the restoring force acts The pistol slide includes a receiving slot within the slide for receiving the slide member, the slot defined by a bottom surface, a breech end side wall, a muzzle end side wall, and a top segment, and formed such that the slide member is received within the slot and approximately flush-mounted with the side surface when the slide member is in the retracted position.

In a third aspect, the present invention is directed to a method of assembling a pistol slide having a slide member rotatably attached thereto, the method comprising: providing an insertion force to a resilient bias member and a plunger within an aperture accessible from a breech end of the pistol slide; pushing the resilient bias member and the plunger towards a muzzle end of the pistol slide such that the plunger is partially exposed in a receiving slot located on a side surface of the slide; inserting the slide member in a partially walled aperture accessible from a top surface of the slide top surface, the side surface, or bath, and aligning a slot within the slide member with a segment extending radially from the plunger during insertion such that the slide member is fully insertable within the receiving slot when the plunger and the side member segment are aligned; and removing the insertion force, such that the resilient bias member provides a restoring force to the plunger.

In a fourth aspect, the present invention is directed to a method of racking a pistol having a pistol slide and a slide member rotatably attached to the pistol slide comprising: grasping a portion of the slide member by sliding a finger laterally outwards along a recessed indent on a top surface of the pistol slide to contact a top portion of the slide member with the finger; extending the slide member laterally outwards away from a side surface of the pistol slide; pulling the slide member towards a breech end of the pistol thereby racking the pistol; and releasing the slide member to allow the slide member to return to a retracted position to ready the pistol for firing.

In a fifth aspect, the present invention is directed to a pistol slide having a top surface, side surfaces adjacent the top surface, a breech end, and a muzzle end opposite the breech end, the pistol slide including at least one extendable and retractable slide member located proximate the breech end of the slide, the slide member rotatable approximately vertically upwards from the top surface to place the slide member in an extended position for grasping.

Preferably, the slide member is approximately flush-mounted with the top surface of the slide when the slide member is in a retracted position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 5A depicts a top perspective view, while FIG. 5B depicts an exploded partial view of the attachment scheme;

DESCRIPTION OF THE PREFERRED EMBODIMENT(S)

In describing the preferred embodiment of the present invention, reference will be made herein to FIGS. 1-29 of the drawings in which like numerals refer to like features of the invention.

In one embodiment, the present invention introduces an extendable slide member on at least one side of a pistol slide action, and preferably on both sides of a pistol slide action that provides leverage and a gripping base for a user to pull back or "rack" the slide along guides on a pistol frame, in a longitudinal motion relative to the pistol frame.

Figure 1:
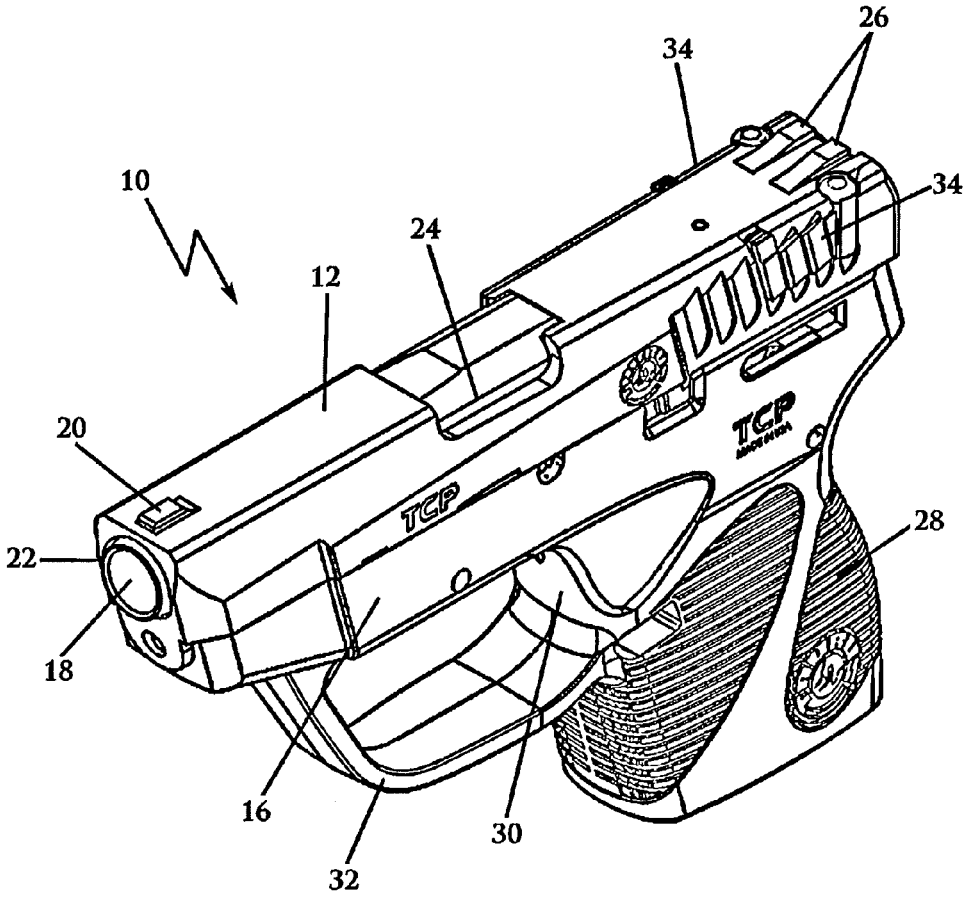
FIG. 1 is a top perspective view of a first embodiment of the present invention depicting a pistol having a slide embodying a slide member of the present invention in its retracted position.

FIG. 1 is a top perspective view of a first embodiment of the present invention, depicting a pistol 10 having a slide 12 embodying slide members 34. Slide 12 is slidably engaged on guide rails (not shown) and movable longitudinally in relation to frame 16 (along the axis of the barrel). In this configuration, slide 12 is in a forward position, before a user retracts or racks the slide to load a cartridge into the chamber. Slide 12 is biased in the forward position, and force must be applied to move the slide towards the breech end of the pistol.

Pistol 10 represents a common pistol construction with general components including a barrel 18, a forward sight 20, a muzzle 22, a slide 12 with an ejection aperture 24, a rear sight 26, a grip 28, trigger 30, and trigger guard 32, to name a few. In this first embodiment, the present invention introduces at least one slide member 34, and in this illustrative example, two slide members 34, that essentially extend a gripping or grasping portion of slide 12 in the lateral direction to facilitate gripping or holding the slide when a user attempts to rack the slide. In this embodiment, two slide members 34 are used, one on each side of slide 12, for delivering a balanced retraction force during racking. Slide members 34 may be integral with slide 12. Slide members 34 may be in a fixed position, extending laterally outwards from slide 12; however, more preferably, slide members 34 are movably attached to slide 12 so that each is an extendable and retractable member. In this manner, slide member 34 provides an extended grip portion or finger-hold for assisting the user in racking the slide without slipping or instigating "slide bite", and can be fully retracted so as not to affect the slim-lined nature of the pistol.

Slide 12 with slide members 34 may still include serrations 42 for enhancing the user's hand grip on the slide. These serrations 42 may further be formed on slide members 34 as well in the event the user elects to rack slide 12 by conventional gripping, without extending slide members 34 laterally outwards.

In FIG. 1, slide members 34 are extendable and retractable components, shown here in a flush mount configuration. That is, in their retracted position, slide member 34 is at least approximately flush with the corresponding longitudinal side of slide 12. A flush mount configuration allows the pistol to have a compact contour, which reduces the chances of having the slide member, and consequently the pistol, catch on clothing or other objects during use, during holstering, and generally when the pistol concealed carried.

Figure 2:
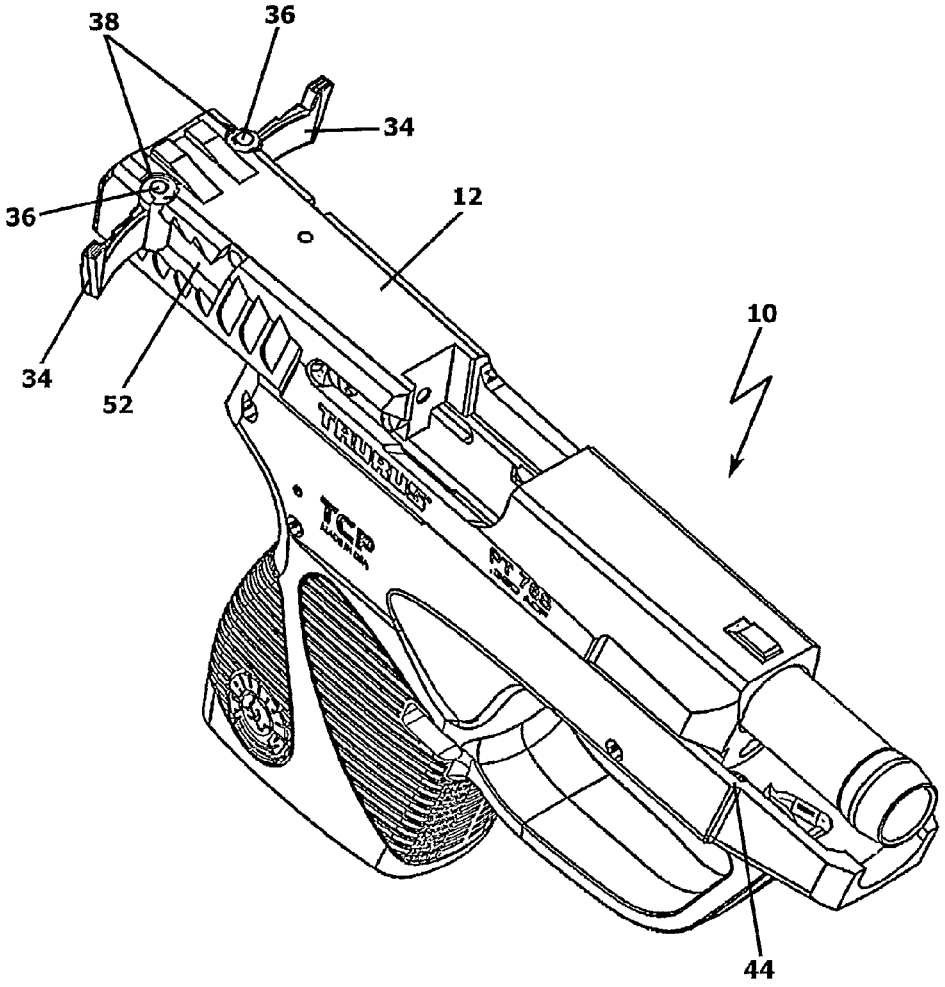
FIG. 2 depicts the pistol of FIG. 1 with the slide in the racked position, with slide members presented in an extended position.

FIG. 2 depicts a perspective view of pistol 10 of FIG. 1 with slide 12 in the racked position, where slide 12 has been pulled back on guide rails 44. Slide members 34 are in the extended position to facilitate racking the slide. In this embodiment, each slide member 34 is rotatably attached to slide 12. As shown in FIG. 2, slide members 34 include an axial, predominantly cylindrical connection segment 36 that may be secured to a complementary cylindrically shaped groove 38 at the breech end of slot 52, which receives slide member 34.

Figure 3:
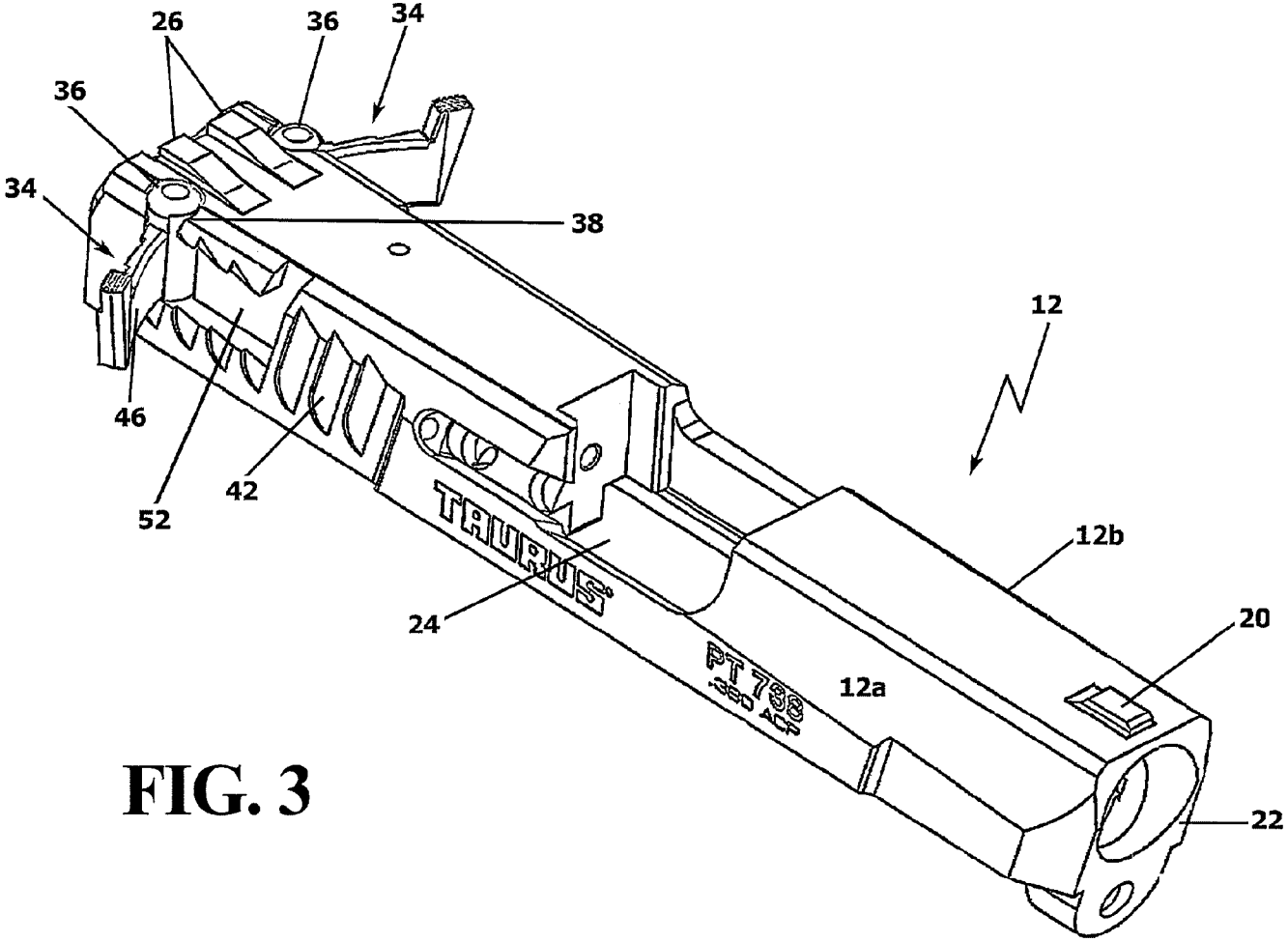
FIG. 3 depicts a perspective view of the slide of FIG. 1 with the slide members in the extended position.

FIG. 3 depicts a perspective view of slide 12 of the present invention with slide members 34 in the extended position. One end of each slide member 34 defines connection column or segment 36 predominantly cylindrical in shape having a longitudinal axis parallel to the respective adjacent face 12*a,b* of slide 12. Connection segment 36 is rotatably secured to slide 12. Slide 12 includes slots 52 to receive each slide member 34. Connection segment 36 of slide member 34 is held in place by a groove 38, which is located at the top portion of slide 12, and forms part of slot 52. Connection segment 36 may be snap-fitted within groove 38, or held in place by the vertical insertion of connection segment 36 within groove 38, such that the curvature of groove 38 extends more than 180° about the cylindrical connection segment 36 to secure the top of connection segment 36 while allowing for rotation.

Figure 4:
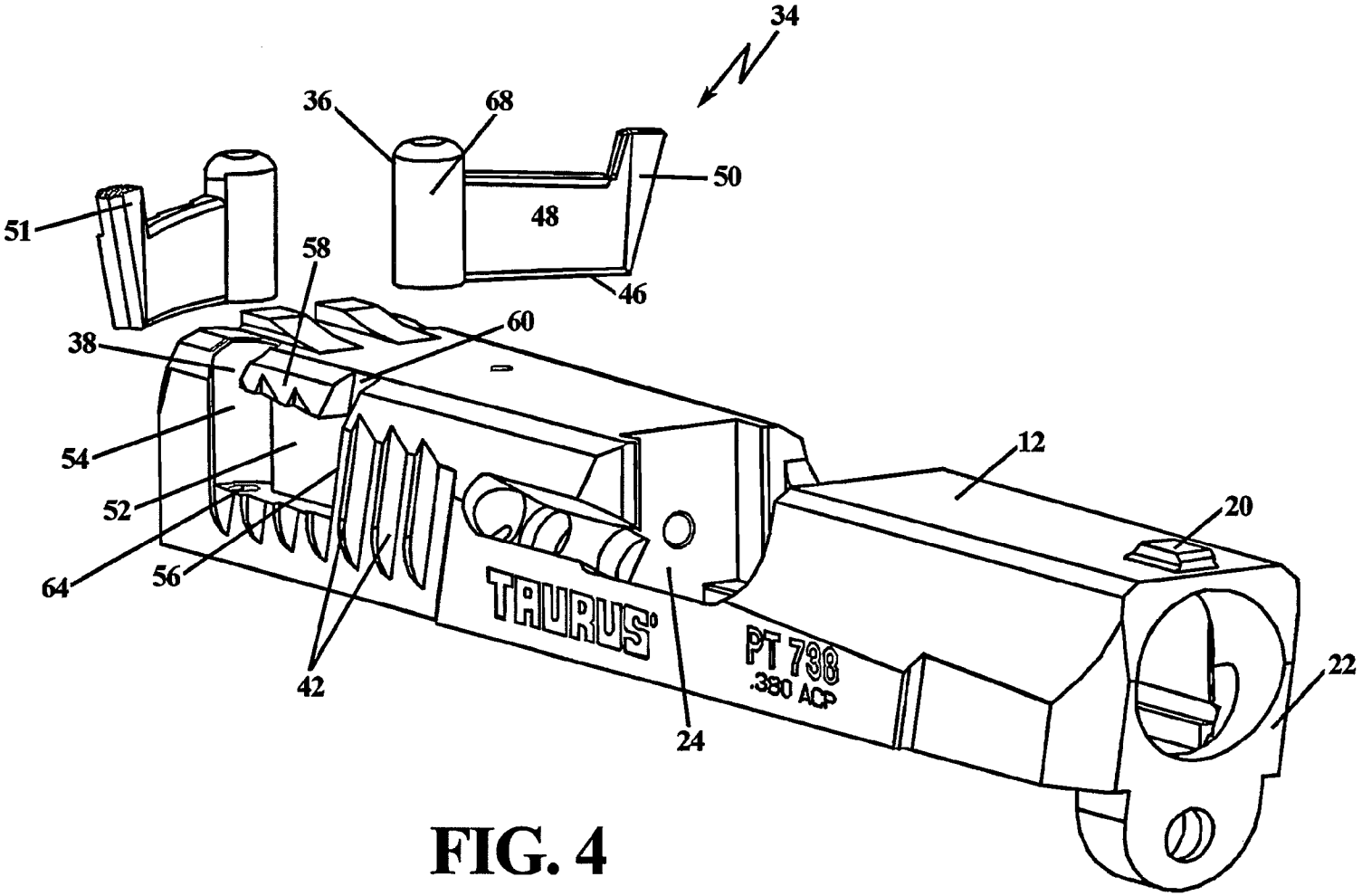
FIG. 4 depicts an exploded view of the slide of FIG. 3 with the slide members shown unattached.

FIG. 4 depicts an exploded view of slide 12 of the first embodiment with each slide member 34 shown unattached. In this exemplary embodiment, slide member 34 includes a lever arm 46 extending from connection segment 36. Lever arm 46, when extended, provides a gripping surface 48 facing the muzzle end of the pistol, for pulling the slide back. Lever arm 46 may be slightly curved concave inwards, towards slide 12 When slide member 34 is in its retraced, flush-mounted position. The curvature assists the gripping action to rack the slide, providing a more secure "hold" for the user's fingers.

When slide member 34 is in the retracted position, lever arm 46 is secured within slot 52 of slide 12. Slot 52 is defined on slide 12 by sidewall 54, located at the breech end of slot 52, and sidewall 56, located at the muzzle end of slot 52. A top segment 58 on slide 34 defines a top portion of slot 52. At one end, top segment 58 extends to, and partially forms, groove 38 with sidewall 54, to assist in securing connection segment 36. At the forward or breech end of slot 52, top portion 58 extends to groove 60 to form a gap with sidewall 56 for securing a handle portion 50 of slide member 34 opposite connection segment 36.

Handle portion 50 of slide member 34 is at an end of slide member 34, opposite connection segment 36, and is an upward extending portion adjacent to, and integral with, lever arm 46. Handle portion 50 is designed to extend at least to the top surface of slide 12 and top segment 58 in order to provide a vertical extension 51 for grasping slide member 34 to extend slide member 34 laterally outwards. Handle portion 50 may further form a snug or snap fit with groove 60, allowing slide member 34 to be held securing in place when in the retracted position.

The bottom surface of slot 52 preferably includes an indentation 64 positioned to receive the center of connection segment 36 when connection segment 36 is placed within groove 38 of slot 52. Indentation 64 is adapted to receive a detent or pin 66 located on the bottom of connection segment 36 of slide member 34 to secure the bottom of connection segment 36 in the bottom of slot 52. Conversely, a detent may be located on the bottom surface of slot 52 and received by an indentation in the bottom of connection segment 36. The combination of the detent/indentation forms a pivot point that secures the bottom of connection segment 36 while allowing for rotation. Curved groove 38 at the upper portion of slot 52 wraps partially around connection segment 36 at the top portion of connection segment 36 and serves to hold rotatable slide member 12.

Figure 5A:
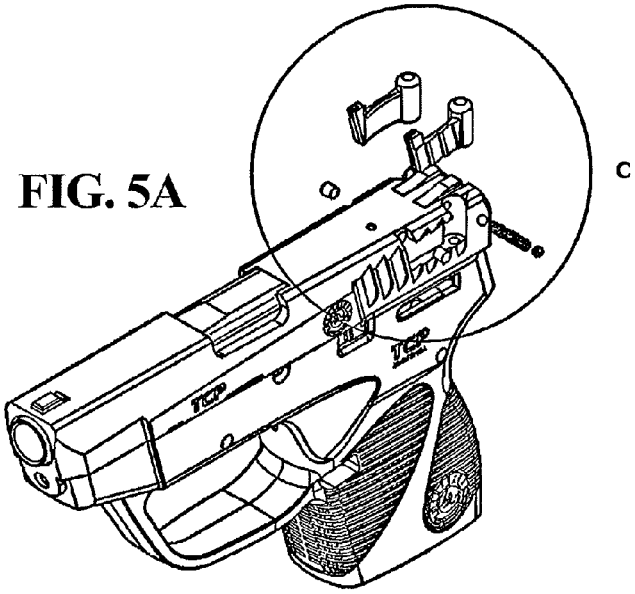
FIGS. 5A and 5B depict an attachment scheme for side mounted slide members.
Figure 5B:
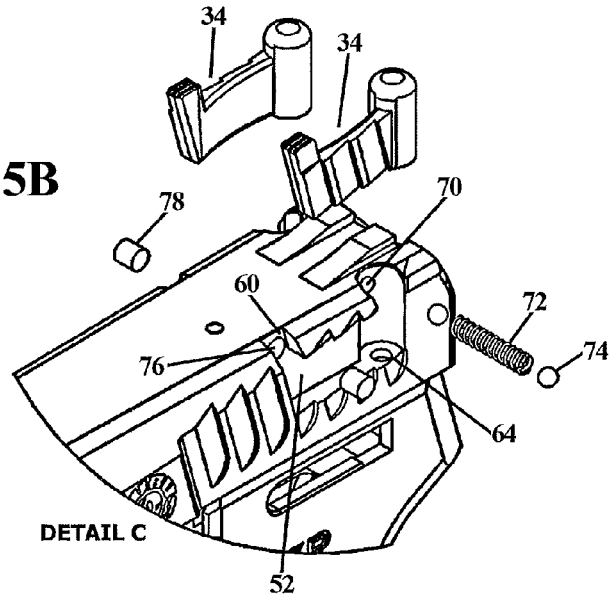

FIGS. 5A and 5B depict an attachment scheme for a side mounted slide member 34. In one embodiment, slot 52 includes a through-hole 70 that is situated behind connection segment 36 of slide member 34. Through-hole 70 is designed to receive a resilient bias member, such as spring 72, and ball bearing 74, that are compressible within through-hole 70 when connection segment 36 is in place.

This attachment mechanism applies a bias force against connection segment 36 to hold slide member 34 in position. Grasping handle portion 50 and extending lever arm 46 laterally outwards will slightly compress bearing 74 against spring 72, allowing connection segment 36 to rotate more easily. Connection segment 36 may include an indentation to receive bearing 74 and secure connection segment 36 in place.

Alternatively, connection segment 36 may include at least one flattened side 68 to assist in forming a "locking" or "secured" indication when slide member 34 is fully retracted within slot 52 (Refer: FIG. 4). When connection segment 36 is rotated to retract slide member 34, flattened side 68 presents an edge to the backside of slot 52 that, upon further retracting rotation of slide member 34, would effectively "click" into place; thereby allowing the user of a positive indication of securing slide member 34.

Additionally, at the opposite end of slide member 34, handle portion 50 may be configured to firmly fit or snap in place within groove 60, providing another securing mechanism and physical indication of attachment. Both fits are sufficient to hold slide member 34 in its retracted position during normal handling of the firearm and during shooting, but resilient enough to allow for hand release and extension of slide member 34.

In another embodiment slide member 34 may be removably secured to the slide by a magnetic contact 78 located within an aperture 76 of slide 12, or complementary magnetic contacts located respectively on slide member 34 and the slide 12. FIGS. 5A and 5B depict an embodiment with slide member held from extension from the slide by a magnetic contact 78.

Figure 6:
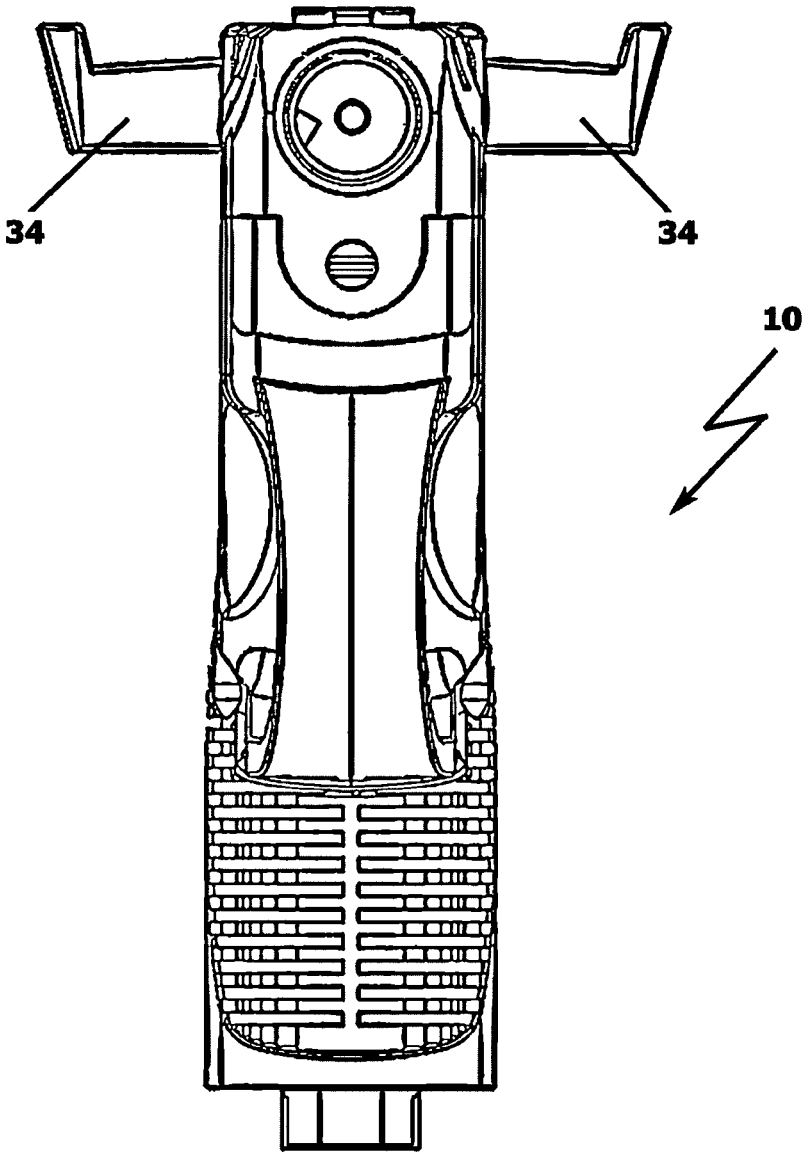
FIG. 6 depicts a front perspective view of the pistol of FIG. 1 with slide members laterally extended.

FIG. 6 depicts a front perspective view of pistol 10 of the first embodiment with slide members 34 laterally extended.

Figure 7:
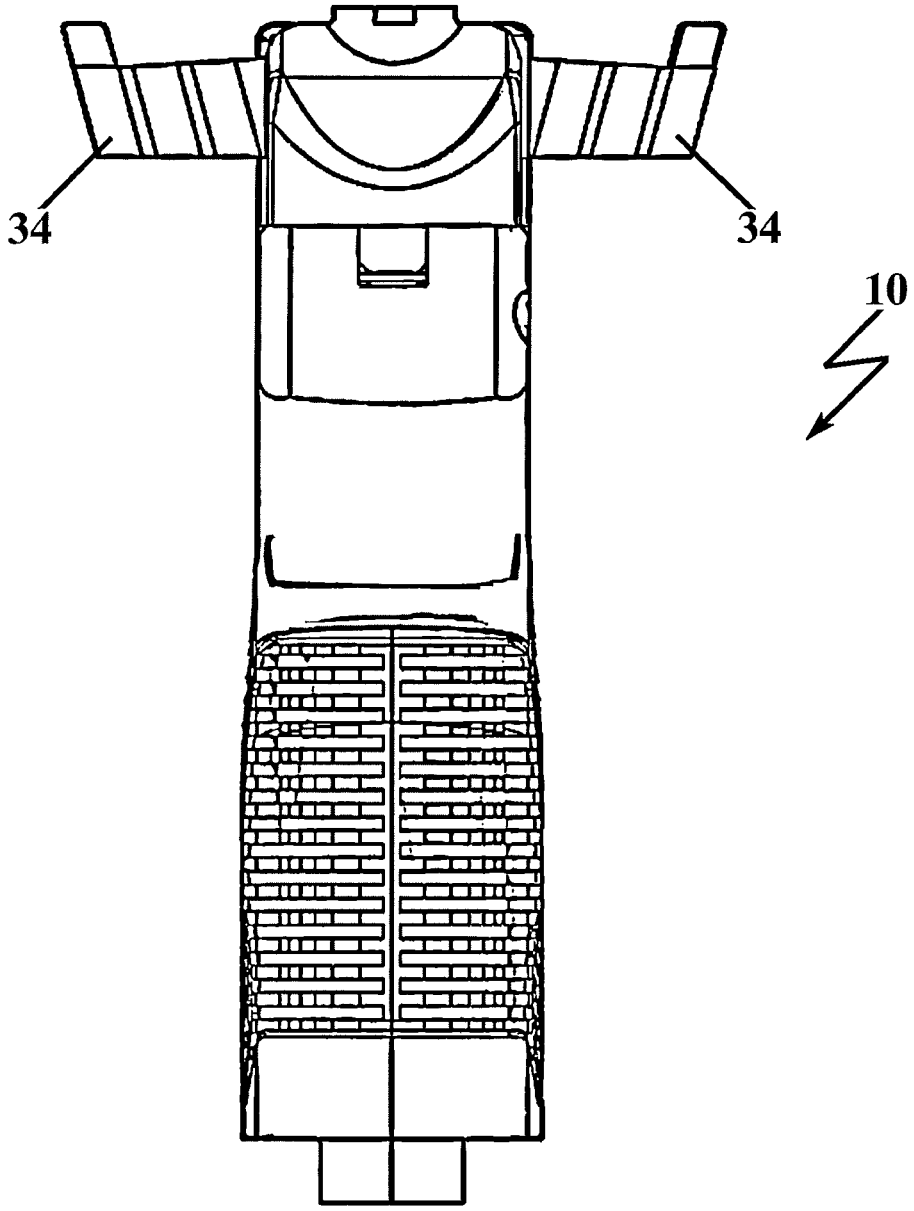
FIG. 7 depicts a back or rear perspective view of the pistol of FIG. 1 with slide members laterally extended.

FIG. 7 depicts aback perspective view of pistol 10 of the first embodiment with slide members 34 laterally extended.

In a second embodiment, slide member or winged extensions are mounted from the back or breech end of the pistol.

Figure 8:
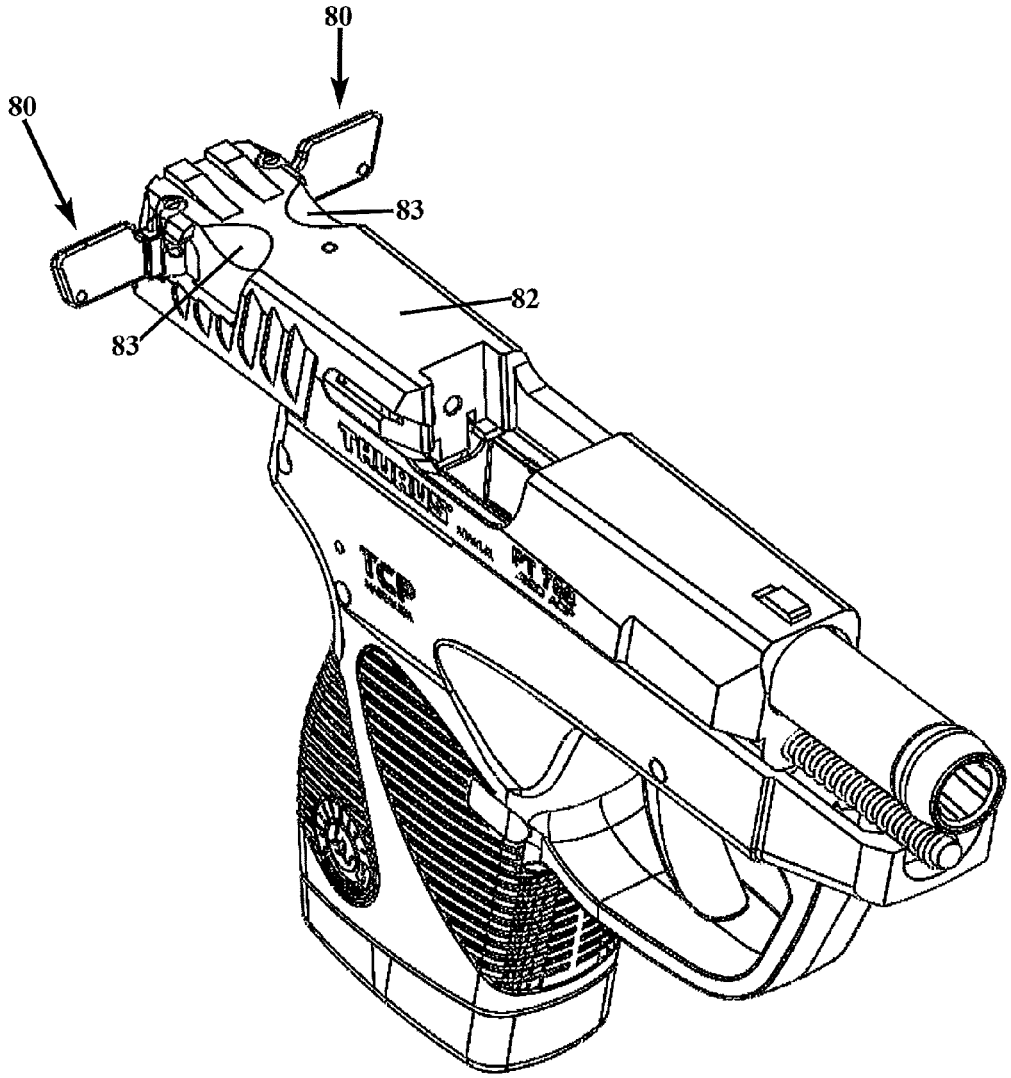
FIG. 8 is a top perspective view of the second embodiment with slide members extending from a retracted slide.

FIG. 8 is a top perspective view of the second embodiment with slide members 80 extending from a retracted slide 82.

Figure 9:
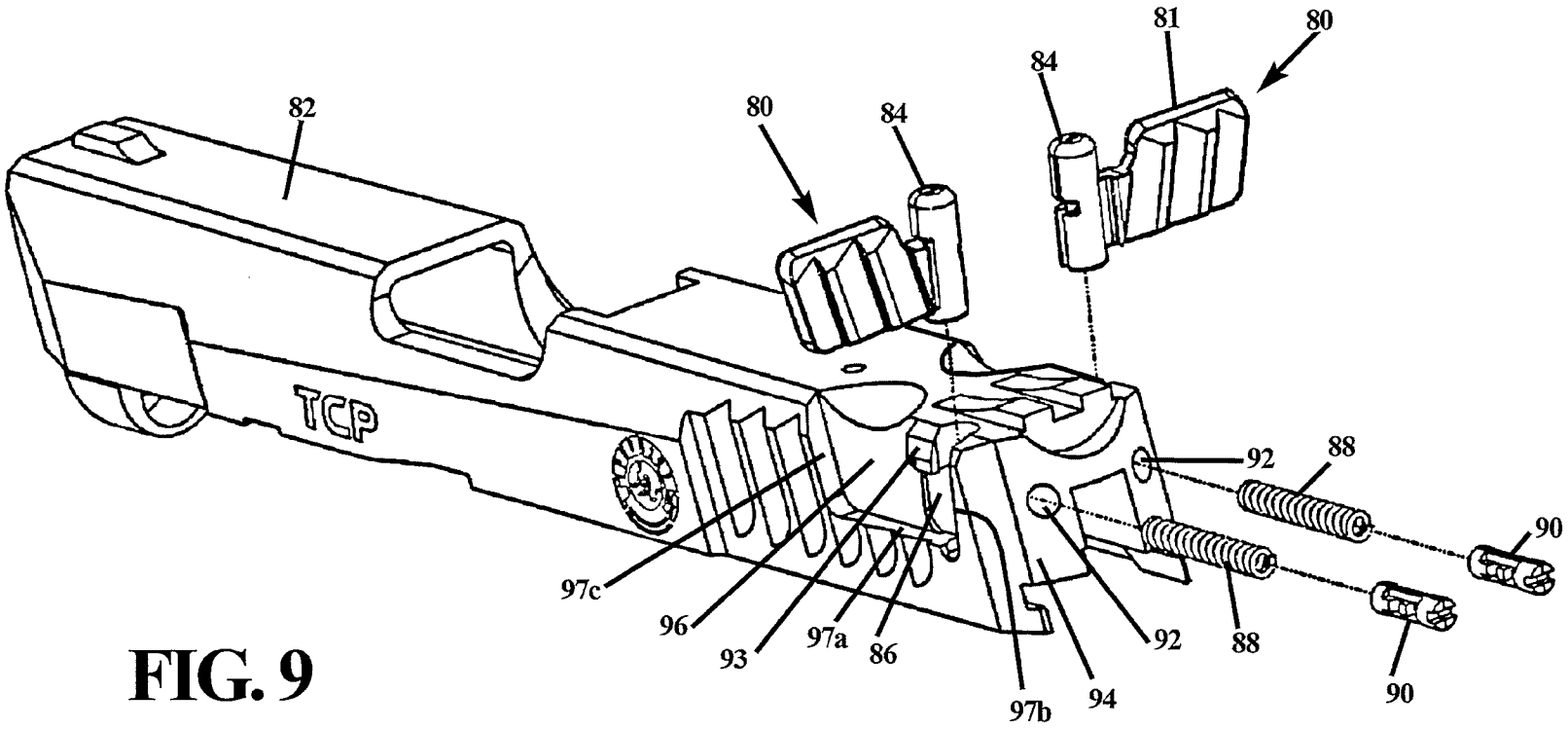
FIG. 9 depicts an exploded view of the slide of FIG. 8 with each slide member shown unattached.

FIG. 9 depicts an exploded view of slide 82 of the second embodiment with each slide member 80 shown unattached. In this embodiment, a winged extension or slide member 80 includes an attachment segment 84, preferably a cylindrical column having a shaped, slotted section that facilitates assembly and assists in presenting a restoring force to an extended (opened) slide member, and provides for rotation of the slide member in respect to the slide. Other attachment segment shapes are envisioned, provided that once the attachment segment of the slide member is actually attached, the slide member is allowed to rotate relative to aside surface of the slide. As an illustrative example, the attachment segment will be described as a cylindrical column 84 that, once inserted within a partially walled aperture 86 within the slide, allows each slide member to rotate. Again, for illustrative purposes only, aperture 86 is preferably a cylindrically shaped slot or hole formed by the side surface wall of slide 82.

Slide member 80 includes a holding or grasping portion 81, which preferably is an approximately flat surface (in the current embodiment, a quasi-rectangular shaped portion) that allows a user to hold the slide member and pull back the slide towards the breech end.

Slide members 80 each have attachment segment 84 that is rotatably held within partially walled aperture 86 in the slide 82. Partially walled aperture 86 extends a portion of the way down from the top surface of the slide, along the slide's side surface. The curved shape of partially walled aperture 86 engulfs a portion of the circumference of the attachment segment 84, which in this example is the preferred cylindrical column 84, thus holding slide member 80 within slide 82. The partially walled aperture does not extend to the bottom of the slide member so that a gap is present to receive the holding portion 81. This configuration secures the slide member to the slide while allowing the slide member to rotate with respect to the slide.

A resilient bias member, such as a spring 88, is used to perform a restoring force to the slide member. The resilient bias member 88 acts to retract an extended slide member back towards the slide. Springs 88 and plungers 90 are inserted from the breech end 94 of slide 82 within apertures 92 that are accessible from breech end 94, and extend to partially walled aperture 86. As will be discussed further herein, resilient bias members 88 provide a retraction or restoration force for open slide members 80 to close, and once closed, to maintain a closing force to ensure each slide member remains within its receiving slot 96 of slide 82. This removes the retraction responsibility from the user, while simultaneously protecting against an inadvertent extension of slide member 80 that could otherwise catch on clothing or other objects.

The receiving slot 96 is an indentation within the slide's side surface, defined by a bottom edge 97*a*, a breech end side wall 97*b*, and a muzzle end side wall 97*c*, formed such that the slide member is received within the receiving slot, and mounts approximately flush with the sidewall surface of the slide.

The slide 82 includes a top segment 93 extending from the upper portion of the slide side surface, which with the breech end side wall 97*b* of the receiving slot forms the partially walled aperture 86. The partially walled aperture is curved to receive arid hold the cylindrical column 84 of slide member 80. Top segment 93 does not extend to the receiving slot bottom edge 97*a*. This gap allows for the rotation of slide member 80 relative to the slide side surface.

The user is able to grasp and extend the slide members by sliding fingers along sloped indentations 83 which traverse from the top surface of slide 82 to a point on the side surface of slide 82 just below the top surface of slide member 80. In this manner, the top surface of slide member 80 is readily accessible for quick extension.

Figure 10:
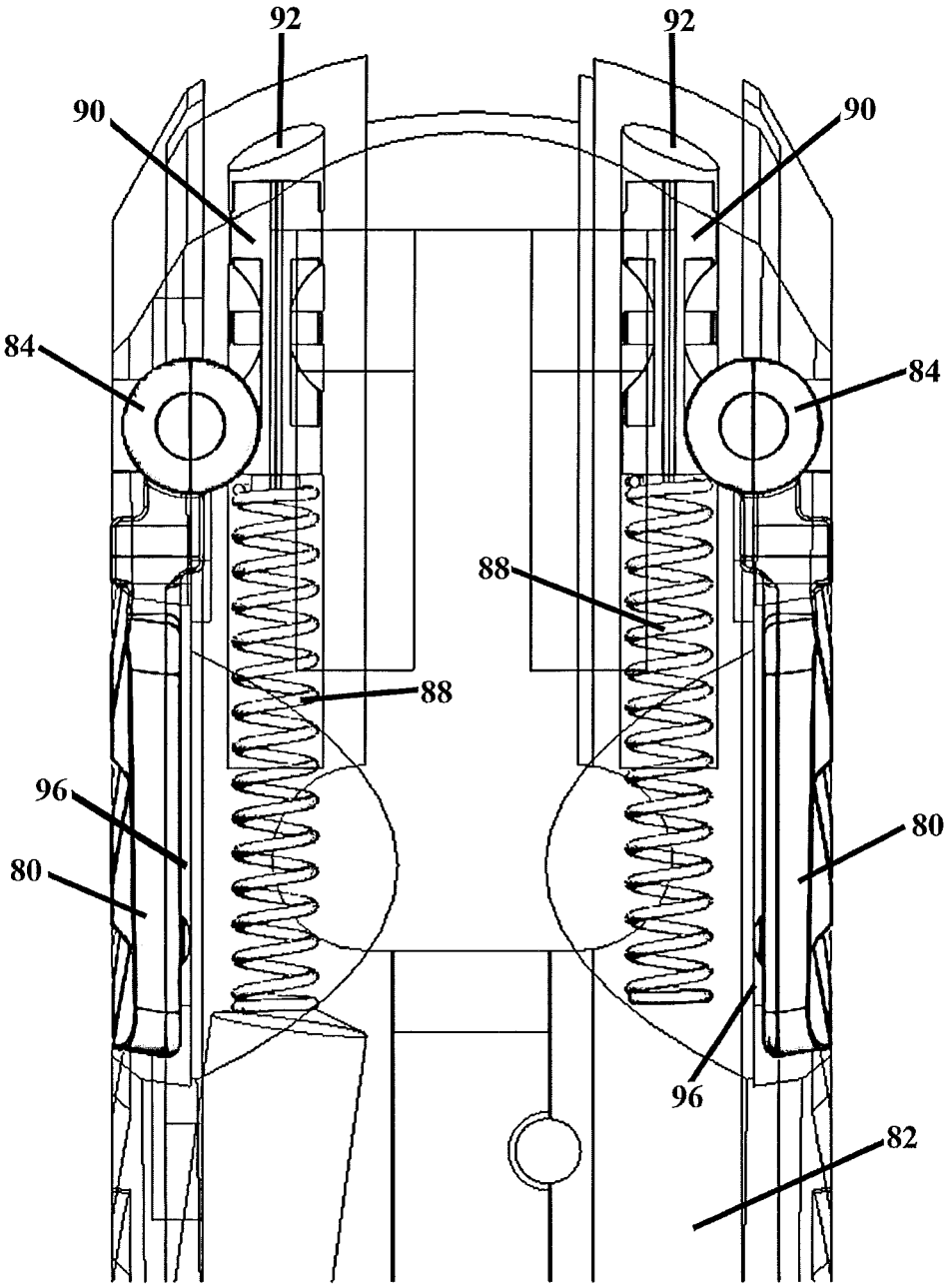
FIG. 10 depicts a top transparent view of the breech end of the slide of FIG. 8 when the slide members are in the closed or static assembled state.

FIG. 10 depicts a top transparent view of slide 82 when slide members 80 are in the closed or static assembled state. In this configuration, slide members 80 are secured within receiving slot 96. Receiving slot 96 is formed within slide 82 such that when slide members 80 are secured therein, there is little or no lateral extension beyond the sides of slide 82. Again, this configuration protects against inadvertent extension and inadvertent capture or snags by extended slide members. Plunger 90 includes a curved or shaped end that is in contact with cylindrical column 84. As will be discussed further herein, the interaction between plunger 90 and the attachment segment (cylindrical column) 84 keeps a constant retraction force on the side member.

Figure 11:
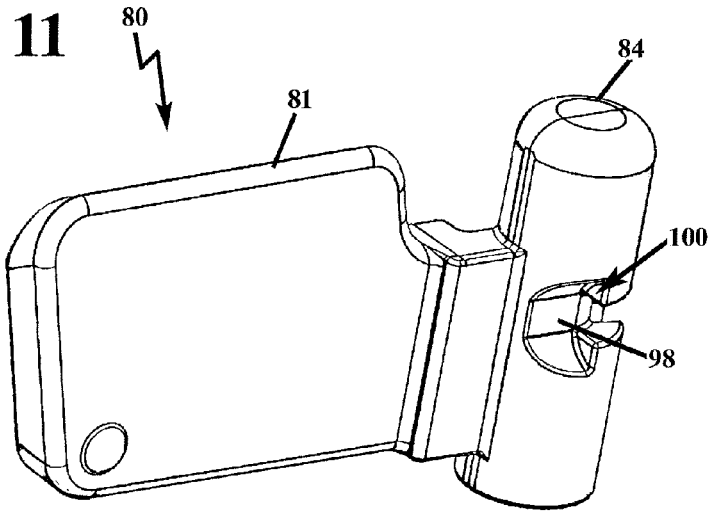
FIG. 11 is a perspective view of the slide member.

FIG. 11 is a perspective view of slide member 80. Attachment segment 84 has a shaped portion that includes a notch 98 approximately at its longitudinal center. Notch 98 is formed to receive a complementary mating surface of plunger 90. Notch 98 includes an edge or other receiving surface, which may be a flat surface 100 that is designed to interact with a complementary mating surface of plunger 90. Notch 98 is formed to fit a top portion of plunger 90.

Figure 12:
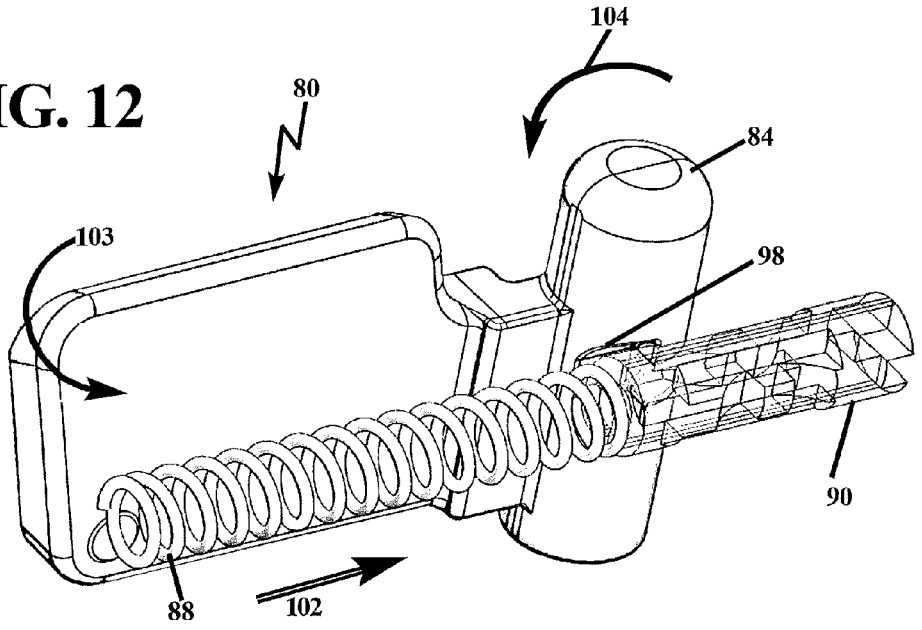
FIG. 12 depicts the slide member of FIG. 11 with a resilient bias member spring and plunger located in the position they would normally be configured when the slide member is in the closed position.

FIG. 12 depicts the slide member 80 of FIG. 11 with resilient bias member (e.g., spring) 88 and plunger 90 located in the position they would normally be configured when slide member 80 is in the closed position within the slide receiving slot (not shown). The forward end of plunger 90 with its complementary mating surface is acted upon by spring 88 in the direction of arrow 102 to maintain a restoration force (in the direction of arrow 102) that serves to rotate slide member 80 in a direction indicated by arrow 103, which is towards the slide side surface. Plunger 90 is held within notch 98. In the position shown, spring 88 provides a force in the back or breech direction, as depicted by arrow 102, which pushes plunger 90 toward the breech end, forcing cylindrical column 84 to rotate in a manner that pivots slide member 80 towards and into the receiving slot.

Figure 13:
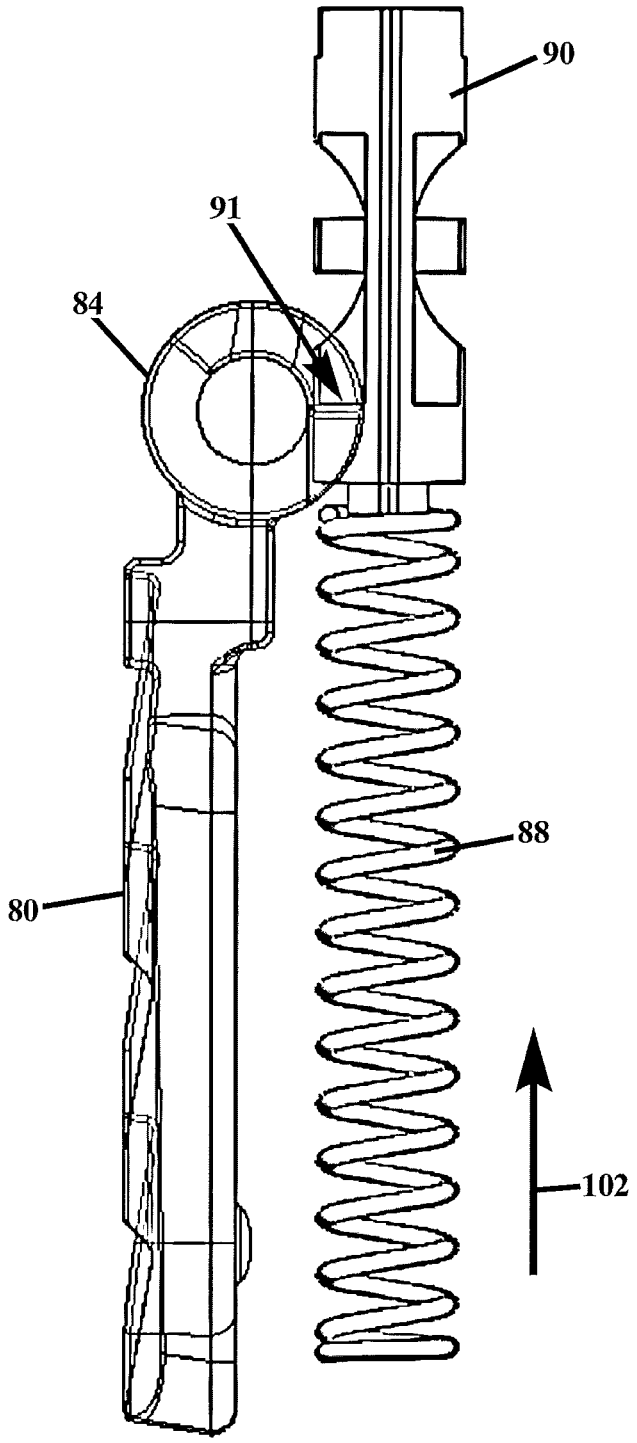
FIG. 13 depicts the relative relationship between the slide member/plunger/spring subassembly when the slide member is in the closed position.

FIGS. 13-19 depict the slide member/plunger/spring subassembly 110 from the closed position (with the slide member 80 within receiving slot 96) to the open position (with slide member 80 extending approximately perpendicular to the longitudinal or axial direction of slide 82). FIG. 13 depicts the relative relationship between these components when the slide member 80 is in the closed position. Spring 88 provides a retraction or restoration force in the direction of arrow 102, which forces plunger 90 in the breech direction. Plunger edge 91 presented proximate the forward end of plunger 90 is in contact with edge 100 of notch 98 in cylindrical column 84. This contact, under the restoration force, causes slide member 80 to rotate towards the slide side surface, and to remain there until acted upon by a user.

Figure 14:
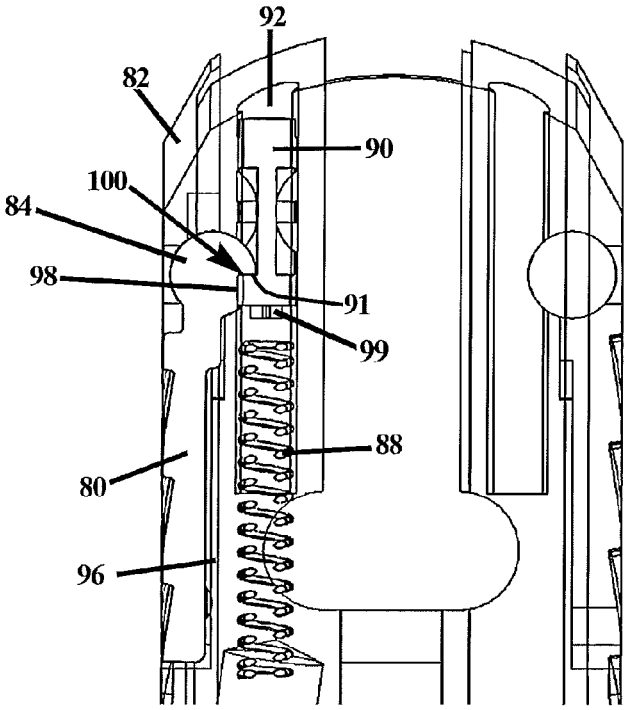
FIG. 14 depicts a top transparent view of the breech end of the slide of FIG. 8 depicting the slide member/plunger/spring subassembly in the closed position.

FIG. 14 depicts a top transparent view of the breech end of the slide 82, showing the slide member/plunger/spring subassembly 110 within the slide. Edge 100 in notch 98 of cylindrical column 84 of slide member 80 is shown in mating contact with edge 91 of plunger 90. These interacting surfaces cause the plunger and spring combination to move in the longitudinal or axial direction (parallel to the length of slide 82) towards the slide's muzzle end when slide member 80 is rotated outwards, away from slide 82. It is this motion by the plunger and spring combination that provides for the restoration force of the slide member when the slide member is rotated into the open position. The muzzle end of plunger 90 includes an attachment and alignment extension 99 that aligns spring 88 when in final assembly. In this figure, attachment and alignment extension 99 is shown for illustrative purposes away from spring 88, but which would remain in contact with spring 88 in final assembly.

Figure 15:
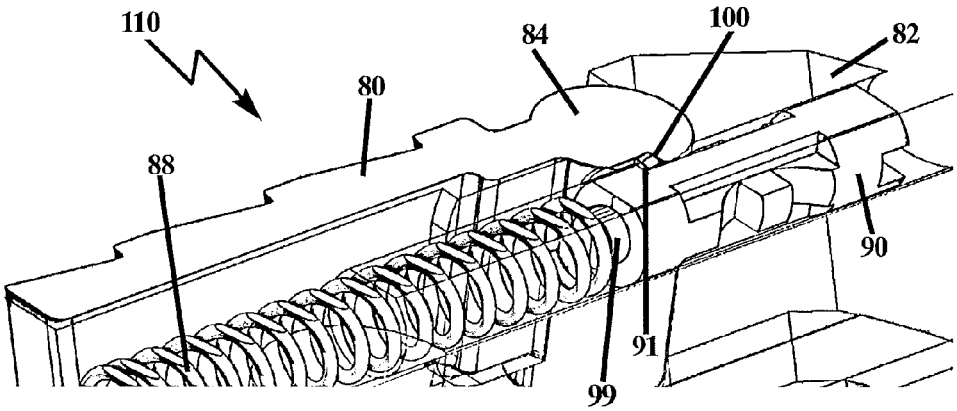
FIG. 15 is an exploded, perspective, partial view of the slide member/plunger/spring subassembly of FIG. 14, depicting the mating surfaces of the plunger and attachment segment of the slide member.

FIG. 15 is an exploded, perspective, partial view of the slide member/plunger/spring subassembly 110 of FIG. 14 in slide 82 in the closed position, depicting the mating surfaces 91 and 100 of the plunger 90 and cylindrical column 84 respectively.

When in the closed position, the force of spring 88 in the breech direction (toward the breech end of slide 82) holds slide member 80 tightly within receiving slot 96 (not shown), such that any extension of slide member 80 will be against the restoring force, which would tend to close the slide member back within receiving slot 96.

Figure 16:
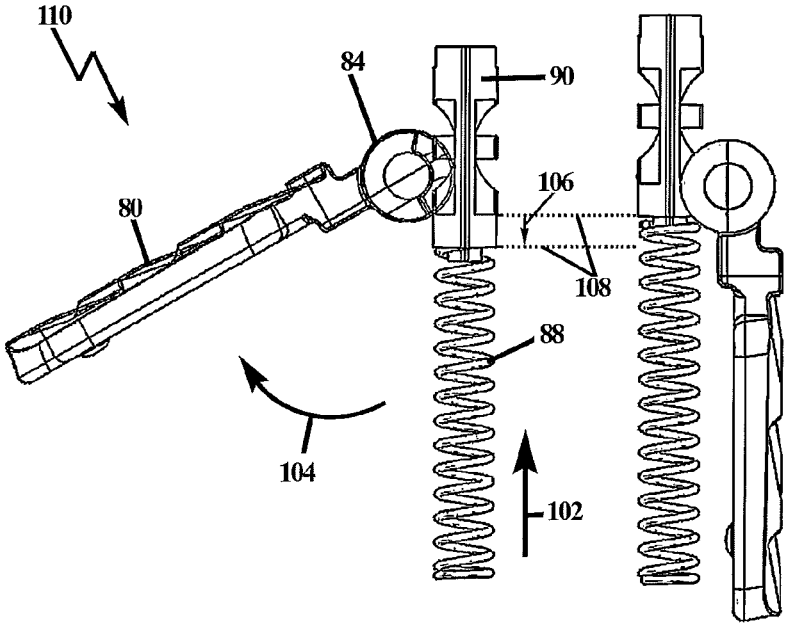
FIG. 16 depicts a comparison of the relative movement of the slide member/plunger/spring subassembly when the slide member is partially opened, moving from the closed position away from the slide, to the same subassembly when the slide member is in the closed position.

FIG. 16 depicts a comparison of the slide member/plunger/spring subassembly 110 when slide member 80 is partially opened, moving from the closed position away from the slide, rotating in the direction of arrow 104, to the same subassembly when the slide member is in the closed position. As slide member 80 is rotated outwards, away from slide 82 in the direction of arrow 104, plunger 90 is moved forward (toward the pistol's muzzle end, and downwards in the figure) by the rotational movement of attachment segment (e.g., cylindrical column) 84 and its corresponding notch edge 100 against the plunger's edge 91. The movement of plunger 90 forward forces the resilient bias member, spring 88, to compress. This in turn introduces an opposing spring force in the breech direction (as indicated by arrow 102), opposite the movement of plunger 90, which acts as a restoring or retraction force that would otherwise initiate a closing action of slide member 80 if not overcome by the user's action to open the slide member. Dashed lines 108 depict the relative movement of plunger 90 in the forward direction from its initially closed position.

Figure 17:
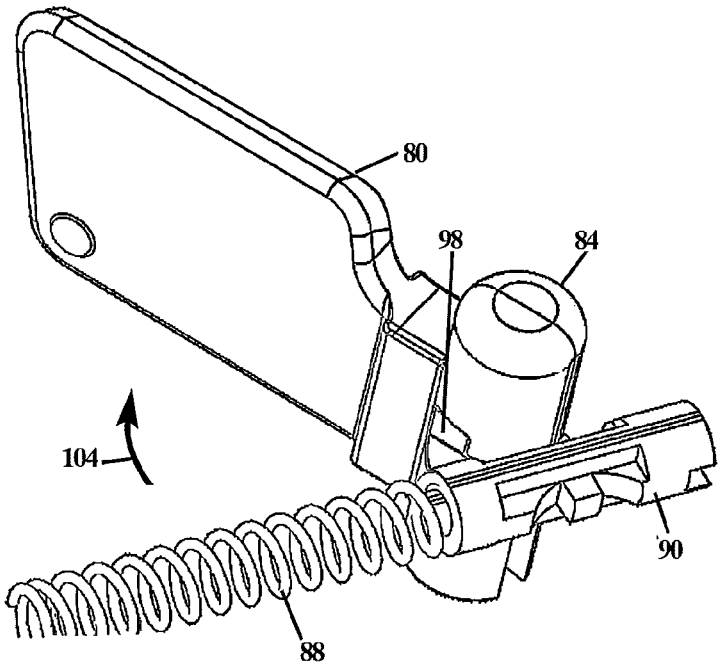
FIG. 17 is a perspective view of the slide member/plunger/spring, subassembly in the partially opened position of FIG. 16.

FIG. 17 is a perspective view of the slide member/plunger/spring subassembly 110 in the partially opened position of FIG. 16. As the slide member is rotated further outwards, the plunger is forced further forward, and the spring is further compressed.

Figure 18:
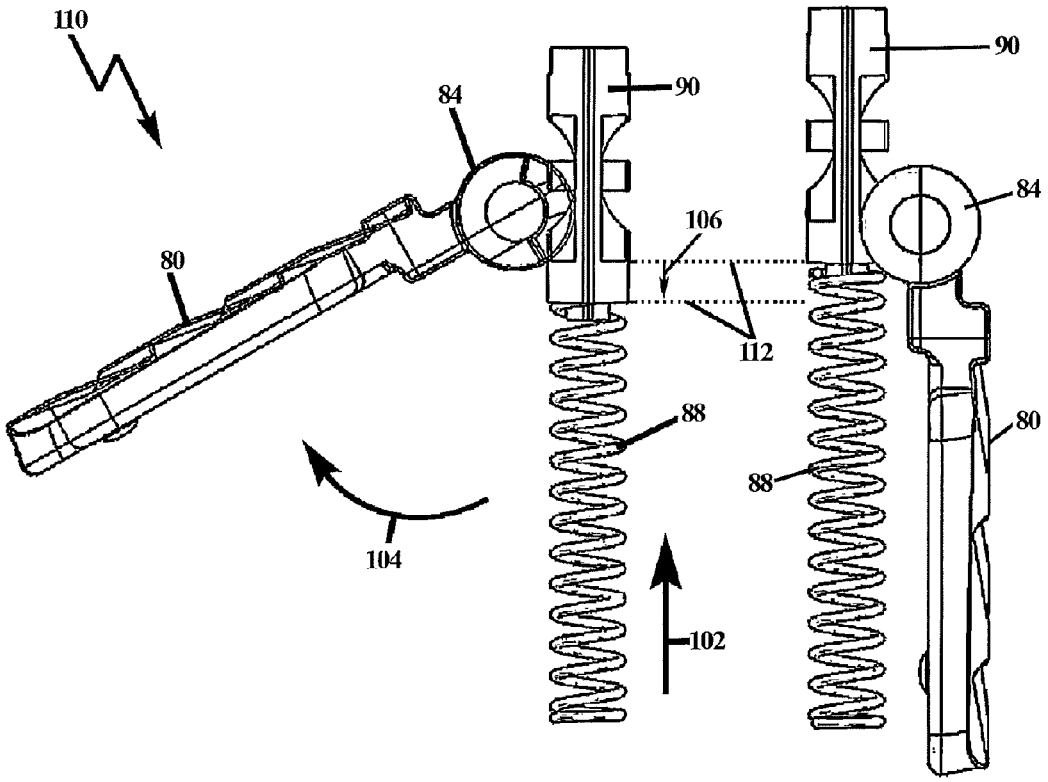
FIG. 18 depicts a comparison of the relative movement of the slide member/plunger/spring subassembly when the slide member is opened further than that of configuration in FIG. 16, to the same subassembly when the slide member is in the closed position.

FIG. 18 depicts a comparison of the slide member/plunger/spring subassembly 110 when slide member 80 is opened further than that of FIG. 16, rotating in the direction of arrow 104, to the same subassembly when the slide member is in the closed position. Plunger 90 is moved further in the direction towards the muzzle end of the pistol.

Figure 19:
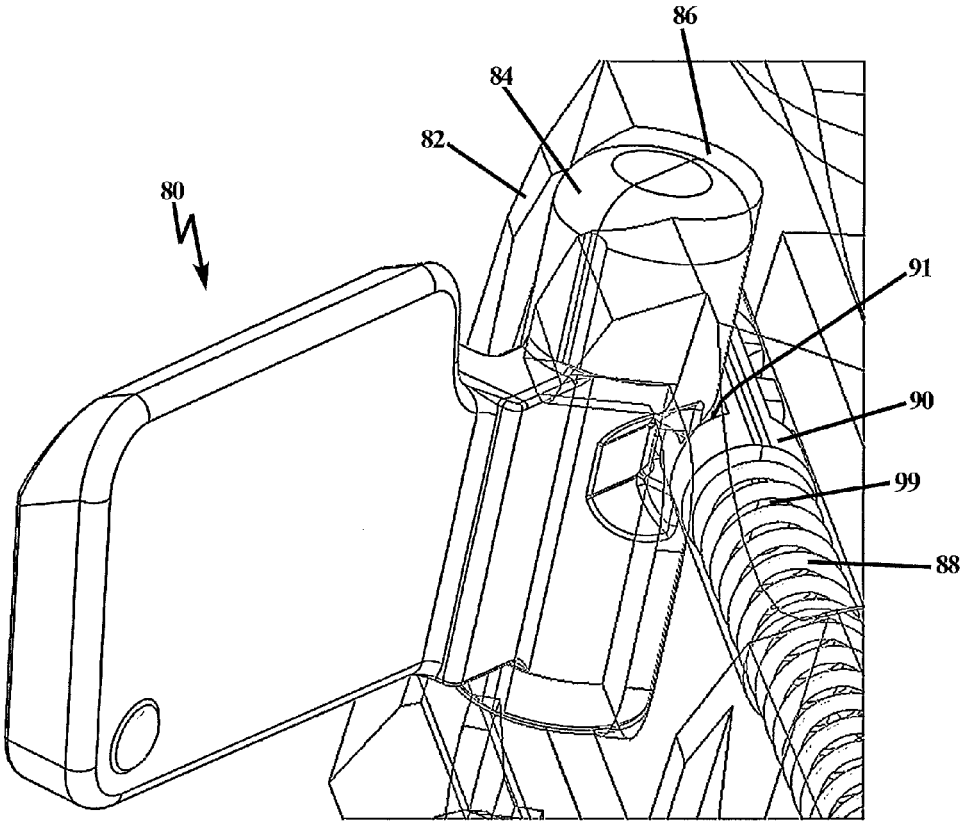
FIG. 19 is a perspective view of a partially extended slide member in a transparent slide.

FIG. 19 is a perspective view of a partially extended slide member of subassembly 110 in a transparent slide 82. This illustrates the contact of notch 98 and edge 100 of attachment segment (cylindrical column) 84 against edge 91 of plunger 90. Spring 88 presents the restoring force against plunger 90 when slide member 80 is in this position.

Figure 20:
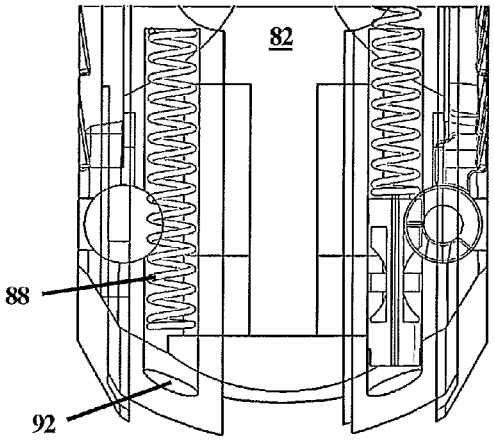
FIG. 20 depicts a transparent view of the breech end of the slide with an unassembled left side member, showing the insertion of the resilient bias member (spring)
Figure 21:
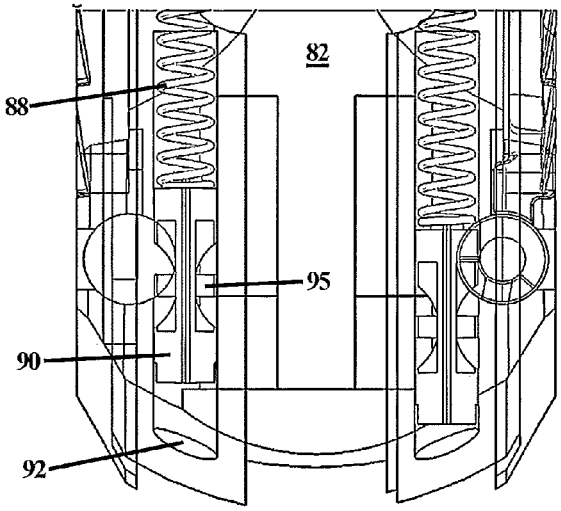
FIG. 21 depicts the slide of FIG. 20 showing the insertion of a plunger that compresses the resilient bias member.
Figure 22:
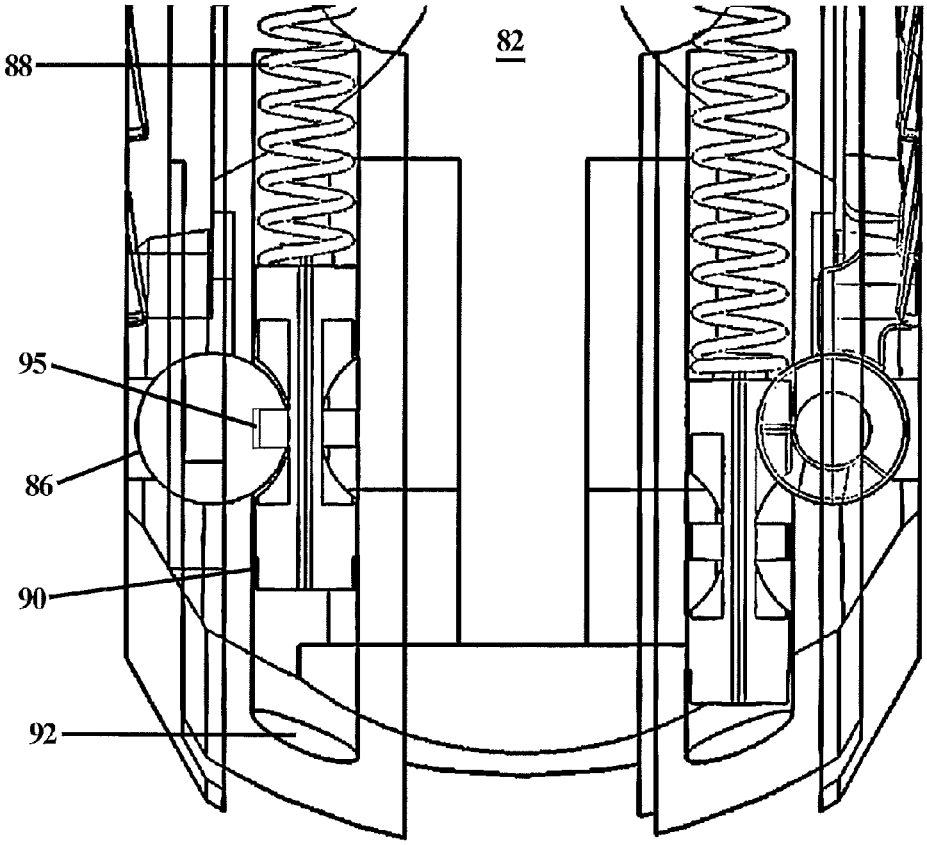
FIG. 22 depicts the plunger pressed into a depth of the aperture so that the plunger peg is visible through the center of the partially walled aperture that receives the slide member attachment segment.

FIGS. 20-24 depict the assembly process for inserting and securing the slide member within the slide. FIG. 20 depicts a transparent view of the breech end of slide 82 that begins the assembly of the slide member/plunger/spring subassembly within slide 82. In these figures, the left side subassembly is being assembled. Spring 88 is first inserted within aperture 92. FIG. 21 introduces plunger 90. Plunger 90 includes a plunger peg 95 that is utilized during assembly for alignment purposes. The breech end of plunger 90 includes an indent (recess) for mating with a tool, such as a small flat-head screwdriver, or it may include a lip for mating with a tool having a recess, which allows plunger 90 to be inserted within aperture 92 and then rotated by the user. The tool is used to orientate plunger 90 such that the plunger peg 95 extends parallel with the top of slide 82 (horizontal as shown in the figure). The plunger is pressed into a depth of aperture 92 so that plunger peg 95 is visible through the receiving slot as depicted in FIG. 22.

Figure 23:
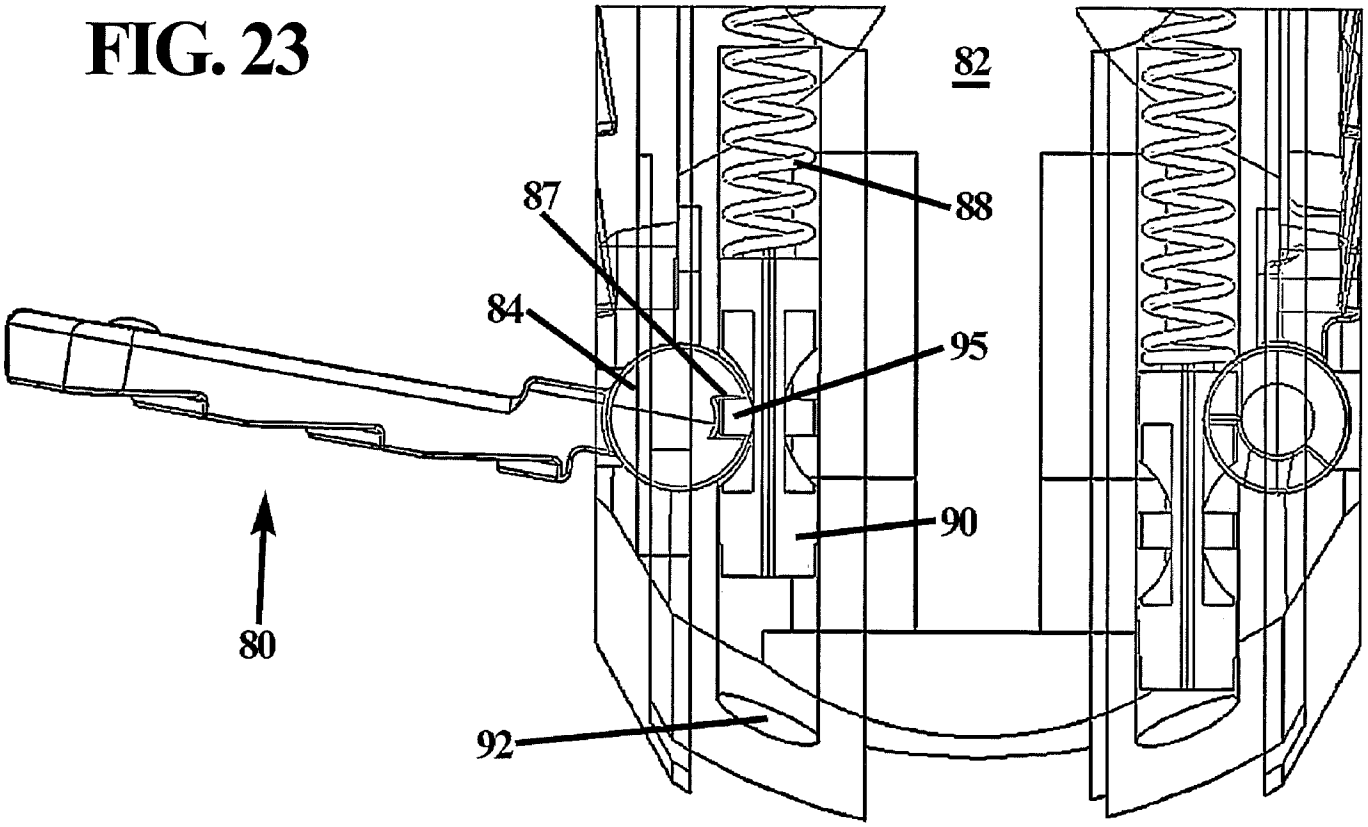
FIG. 23 shows the interaction of the plunger peg upon insertion of the slide member attachment segment, which is shown as a cylindrical column keyway.

Once the plunger peg is aligned and visible within receiving slot 96 and centered about partially walled aperture 86, attachment segment 84 of slide member 80 is inserted within partially walled aperture 86. The attachment segment (cylindrical column) 84 includes a receiving groove or keyway 87 that aligns with plunger peg 95 during insertion. Keyway 87 extends from the bottom of cylindrical column 84 to a center radial groove 89. Keyway 87 is perpendicular to center radial groove 89. As cylindrical column 84 is inserted into partially walled aperture 86, keyway 87 aligns with peg 95. FIG. 23 shows the interaction with keyway 87 and plunger peg 95. This allows the cylindrical column to be inserted from the top side of slide 82, and slide past plunger peg 95 into place within slot 86.

Figure 24:
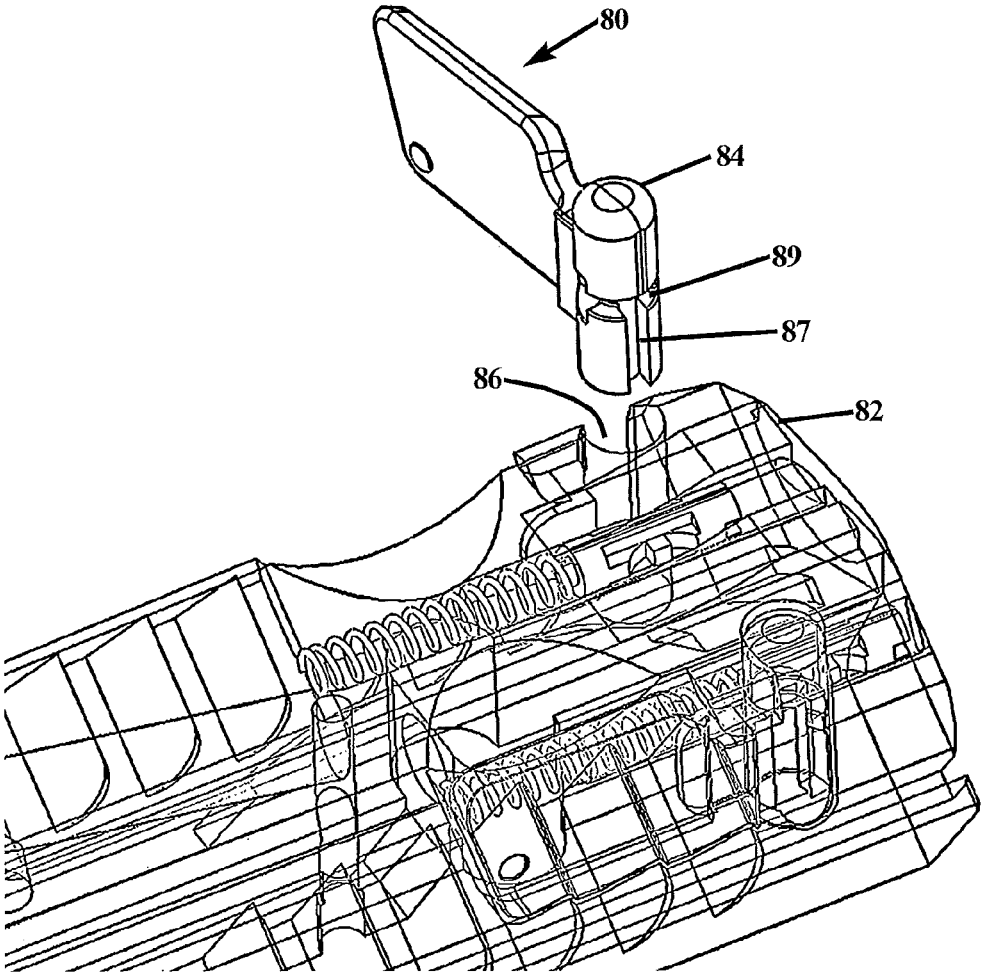
FIG. 24 depicts an exploded view of the slide member being inserted within the partially walled aperture, the attachment segment of the slide member having a keyway and partial circumferentially traversing slot for receiving the plunger peg.

FIG. 24 depicts an exploded view of the slide member 80 being inserted within partially walled aperture 86. Center radial groove 89 and keyway 87 are shown on cylindrical column 84. When cylindrical column 84 is resting at or near the bottom of partially walled aperture 86, plunger 90 will have clearance within center radial groove 89. At this point in the assembly process, the plunger 90 is "released"; that is, the tool holding plunger 90 in place against the restoration force of spring 88 is removed. Edge 91 of plunger 90 comes in contact with edge 100 of notch 98 of cylindrical column 84. Spring tension is translated to plunger 90, which in turn translates the tension to cylindrical column 84 and ultimately slide member 80, forcing slide member 80 to rotate to its closed position.

The geometry between the slide member and the plunger creates a locking feature such that the slide member cannot come loose, or be pulled out, without first pressing the plunger within aperture 92 deep enough to expose the aligned plunger peg to the hole.

The pistol slide and slide member of the present invention present a unique method for racking the slide. Essentially, a portion of the slide member initially placed in a retracted position is grasped, and the slide member is rotated laterally outwards from a side surface of the slide or vertically upwards from a top surface of the slide, such that said slide member is placed in an extended position. At this point, the slide member is grasped by the shooter, and pulled towards a breech end of the pistol. Upon release, the slide member is restored to its retracted position under spring tension.

Figure 25:
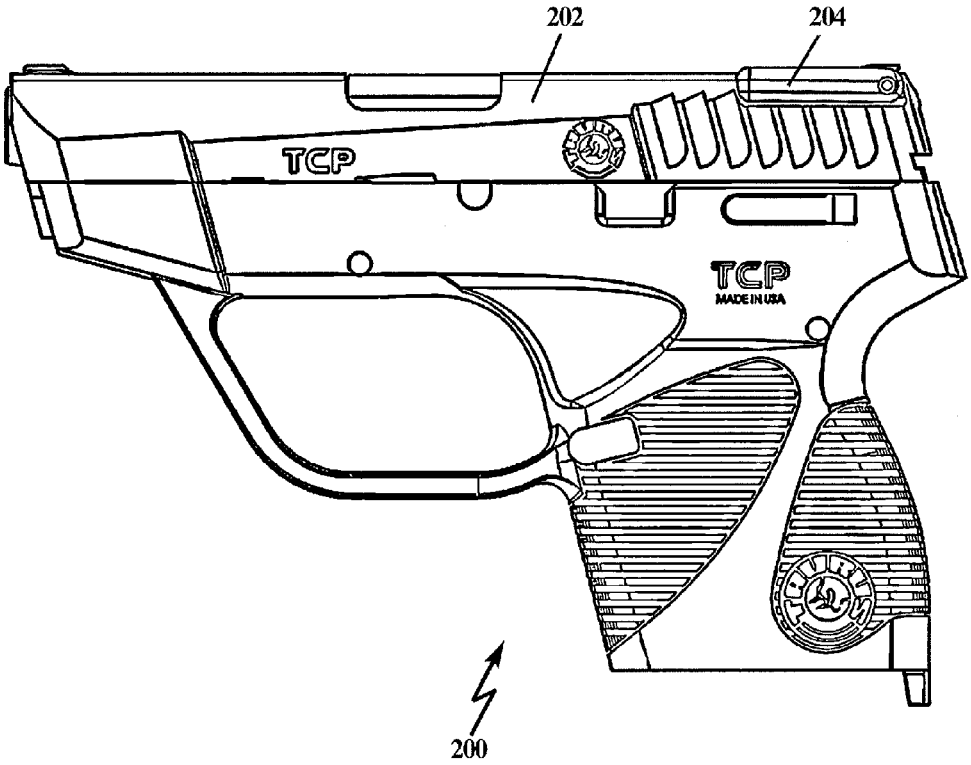
FIG. 25 depicts a pistol with a retracted, top mounted slide member at the back or rear end of the slide.
Figure 26:
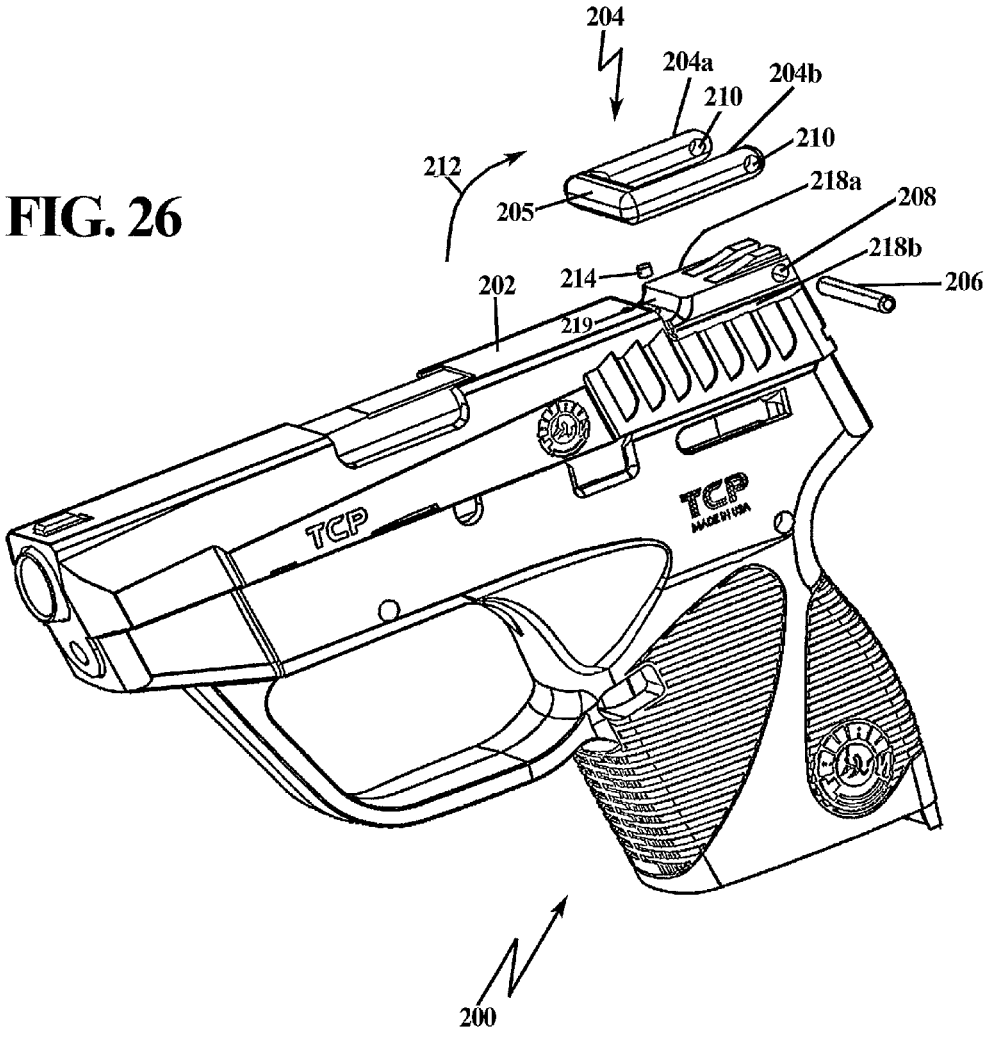
FIG. 26 is an exploded view of the pistol of FIG. 25 depicting an attachment scheme for the slide member.

In a separate embodiment, a slide member may be top mounted as depicted in FIG. 25. FIG. 25 depicts pistol 200 with retracted, top mounted slide member 204 shown at the back or rear end of slide 202. FIG. 26 is an exploded view of pistol 200 depicting an attachment scheme for slide member 204. Slide member 204 is attached at the back end of slide 202 by an axial rod 206 inserted within through-hole 208. Slide member 204 is preferably U-shaped (although other shapes are not precluded) with leg members 204*a,b* and front member 205. Each leg member includes an aperture 210 located at the rearward end of slide member 204, Which is adapted to receive axial rod 206. in this manner, slide member 202 is rotatable in the direction of arrow 212, extending upwards and rearwards relative to pistol 200. Front member 205 of slide member 204 is received by slide 202 in side grooves 218*a,b* and front groove 219. Side grooves 218*a,b* are designed to receive leg members 204*a,b* of slide member 204, respectively. Front member 205 may be magnetically secured to slide member 204 by magnetic contact 214.

Figure 27:
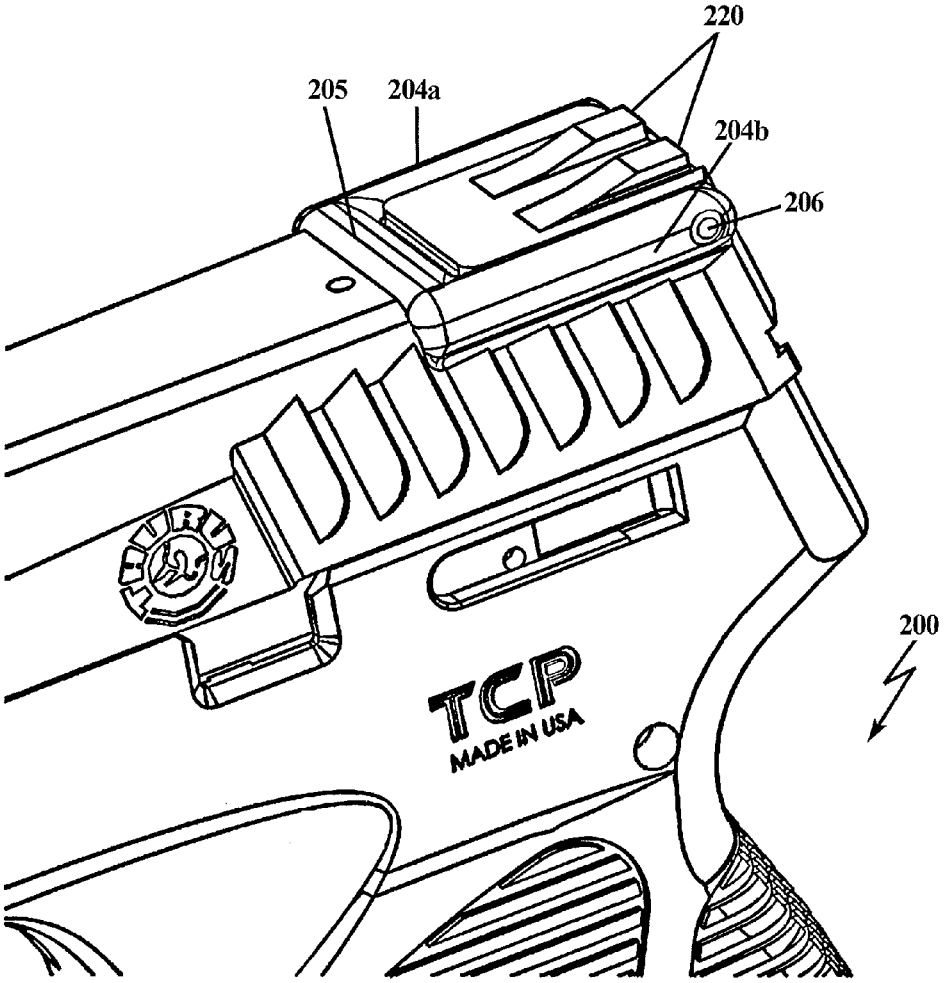
FIG. 27 is an exploded, partial, top perspective view of the pistol of FIG. 25, depicting the placement of the slide member in its retracted position.

FIG. 27 is an exploded, partial, top perspective view of pistol 200, depicting the placement of slide member 204 in its retracted position. The U-shaped slide member 204 is secured in grooves in the slide member, such that slide member 204 surrounds, but does not interfere with, rear sights 220.

Figure 28:
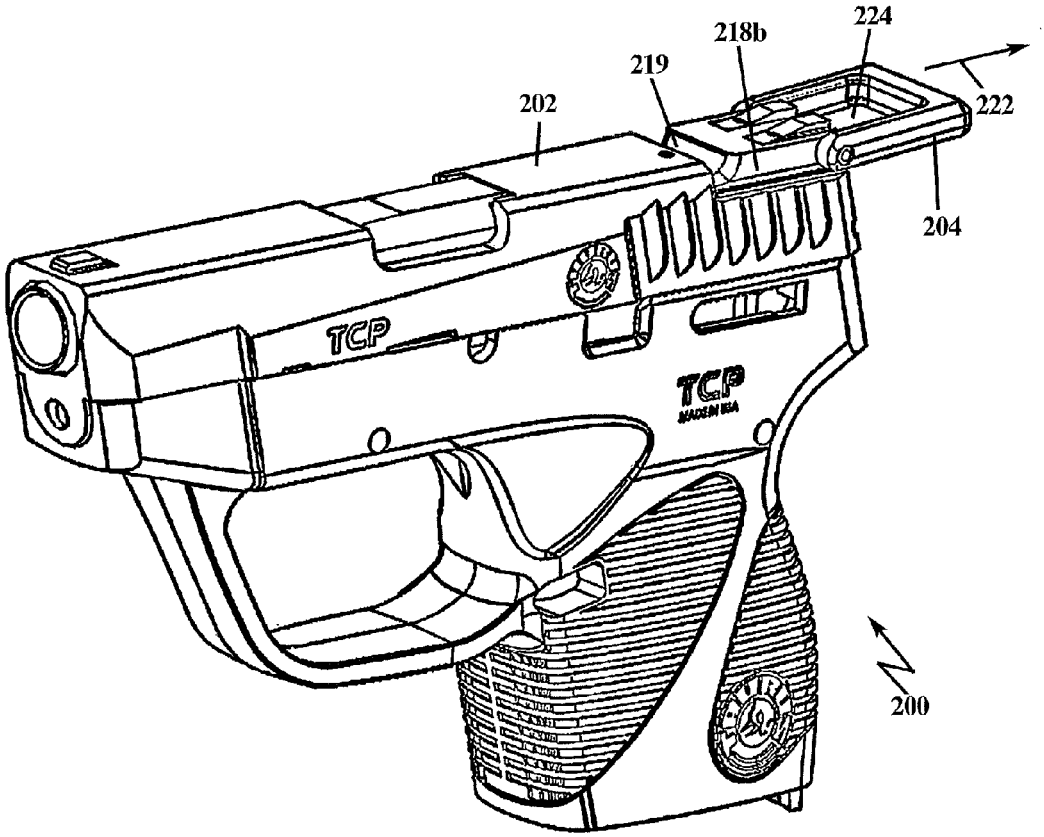
FIG. 28 depicts the pistol of FIG. 25 with the slide member in the extended, rearward position, with the slide still in its firing position.

FIG. 28 depicts pistol 200 with slide member 204 in the extended, rearward position, with slide 202 still in its firing position. A user may pull slide member 204 rearwards in the direction of arrow 222 using a single finger pull in gap 224.

Figure 29:
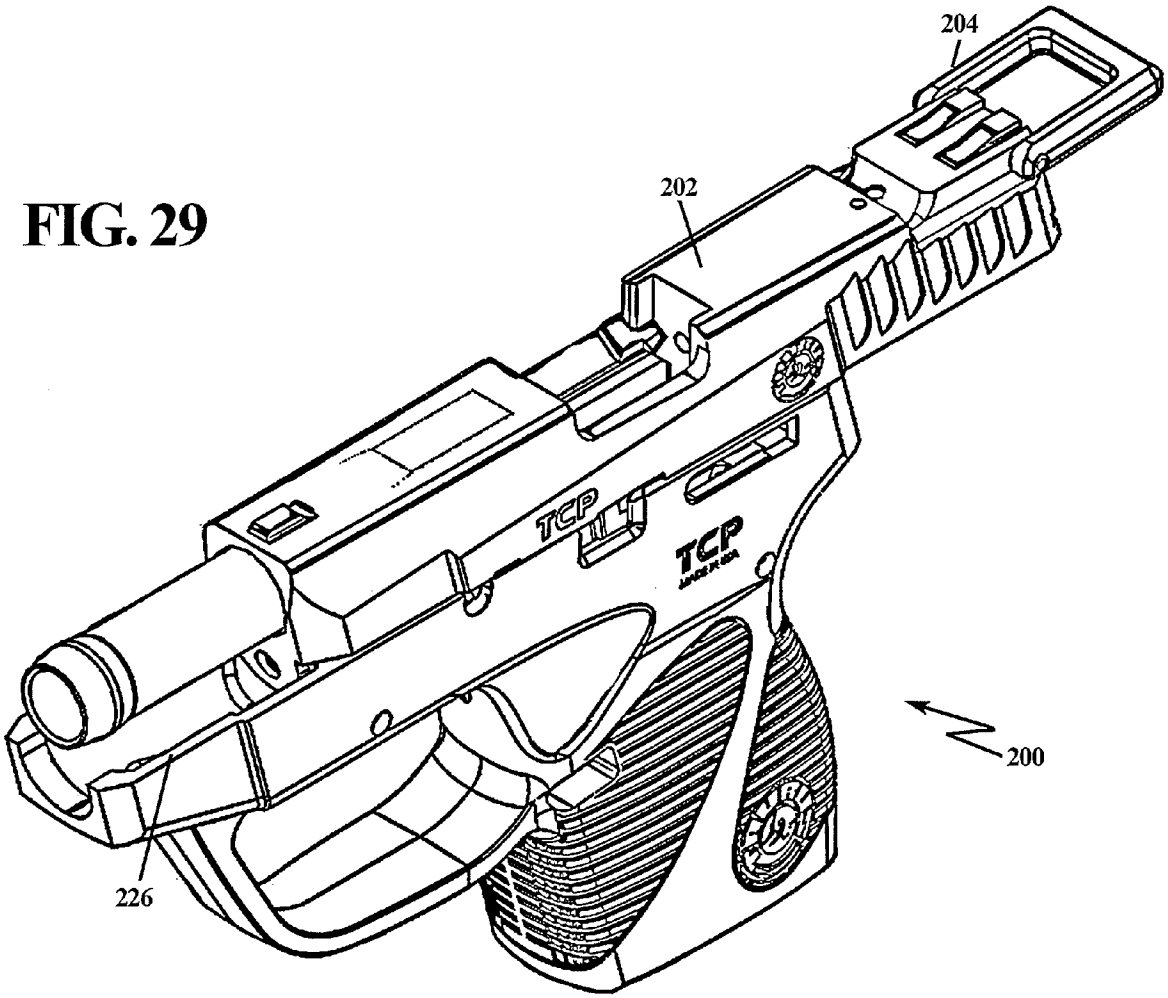
FIG. 29 depicts the pistol of FIG. 28 with the slide member extended, and the slide pulled or racked rearward on guides.

FIG. 29 depicts the pistol of FIG. 28 with slide member 204 extended, and slide 202 pulled rearward on guides 226.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A pistol slide having a top surface facing upwards when said pistol is held in an upright firing position, side surfaces adjacent said top surface and facing outwards left and right in a direction perpendicular to said top surface, a breech end, and a muzzle end opposite said breech end, said slide including:

at least one partially walled aperture located proximate said breech end of said slide having an opening accessible from said slide top surface or said slide side surface, or both;

at least one extendable, retractable slide member, said slide member extendable approximately laterally outwards from said side surface in a direction approximately perpendicular to said top surface when said slide member is in an extended position, said slide member including: a top edge, a holding portion, and an attachment segment, said attachment segment being insertable within said at least one partially walled aperture for rotatably attaching to said slide;

a resilient bias member providing a restoring force to said at least one slide member when said at least one slide member is extended laterally outwards, said restoring force acts to retract said at least one slide member laterally inwards towards said slide side surface.

2. The pistol slide of claim 1 wherein said slide includes:

a receiving slot in at least one side of said slide to receive said slide member holding portion when said slide member is in its fully retracted or closed position; and a sloped indent located on at least one side of said slide top surface, and extending in a sloping fashion from a point proximate a center of said slide top surface toward said slide side surface to a position below said slide member top edge.

3. The pistol slide of claim 2 wherein said slide member is approximately flush-mounted with said side surface of said slide when said at least one slide member is in a retracted position within said receiving slot.

4. The pistol slide of claim 2 wherein said receiving slot is indented within said slide side surface, said receiving slot formed by a bottom surface, a breech end side wall, and a muzzle end side wall, such that said slide member is received within said receiving slot.

5. The pistol slide of claim 4 wherein a top segment extending from said slide side surface and said breech end side wall of said receiving slot form said at least one partially walled aperture.

6. The pistol slide of claim 5 wherein said attachment segment comprises an approximate cylindrically shaped column for rotatably attaching to said slide at said partially walled aperture.

7. The pistol slide of claim 6 wherein said partially walled aperture extends circumferentially more than 180° about said approximate cylindrically shaped column of said attachment segment, securing said attachment segment within said partially walled aperture while simultaneously allowing said attachment segment to rotate relative to said slide.

8. The pistol slide of claim 1 including:

an aperture within said slide accessible from said slide breech end and extending to said receiving slot;

said resilient bias member insertably supportable within said aperture, forming a biased detent for said attachment segment; and a plunger biased by said resilient bias member insertably supportable within said aperture and slideably movable within said aperture toward said slide muzzle end to a position where said plunger is exposed to said receiving slot.

9. The pistol slide of claim 8 wherein said attachment segment includes a notch having a mating surface; and said plunger includes a complementary mating surface in contact with said attachment segment mating surface.

10. The pistol slide of claim 9 wherein said attachment segment mating surface and said plunger complementary mating surface, when in contact, cause said plunger and resilient bias member combination to move in an axial direction parallel to said slide side surface when said slide member is rotated outwards, away from said slide, which provides said restoring force to said slide member.

11. The pistol slide of claim 8 wherein said plunger includes a peg extending radially therefrom for assembling a side member/plunger/resilient bias member combination within said slide, said peg insertable within a keyway located within a bottom portion of said attachment segment, said attachment segment including a radial groove to allow said peg to retract towards said breech end of said slide after insertion.

12. A pistol comprising:

a frame for holding mechanical parts of said pistol, including a trigger housing and a bolt carrier group, said frame further includes a grip portion that receives a magazine;

a slide, longitudinally slidable with respect to said frame, said slide housing a firing pin or striker of said pistol and an extractor, said slide serves as a bolt for said pistol, said slide having a top surface facing upwards when said pistol is held in an upright firing position, side surfaces adjacent said top surface and facing outwards left and right in a direction perpendicular to said top surface, a breech end, and a muzzle end opposite said breech end, said slide including:

at least one partially walled aperture located proximate said breech end of said slide having an opening accessible from said slide top surface or said slide side surface, or both;

at least one extendable, retractable slide member, said slide member extendable approximately laterally outwards from said side surface in a direction approximately perpendicular to said top surface when said slide member is in an extended position, said slide member including: a top edge, a holding portion, and an attachment segment, said attachment segment being insertable within said at least one partially walled aperture for rotatably attaching to said slide; and a resilient bias member providing a restoring force to said at least one slide member when said at least one slide member is extended laterally outwards, said restoring force acts.

13. The pistol of claim 12 including a receiving slot within said slide for receiving said slide member, said slot defined by a bottom surface, a breech end side wall, a muzzle end side wall, and a top segment, and formed such that said slide member is received within said slot and approximately flush-mounted with said side surface when said slide member is in said retracted position.

14. The pistol of claim 13 wherein said top segment and said breech end side wall of said slot form a partially walled aperture for receiving said attachment segment.

15. The pistol of claim 12 including:

an aperture within said slide accessible from said slide breech end and extending to said receiving slot;

said resilient bias member insertably supportable within said aperture, forming a biased detent for said attachment segment; and a plunger biased by said resilient bias member insertably supportable within said aperture and slideably movable within said aperture toward said slide muzzle end to a position where said plunger is exposed to said receiving slot.

16. The pistol of claim 15 wherein said resilient bias member comprises a spring.

17. The pistol of claim 15 wherein said attachment segment includes a notch having a mating surface; and said plunger includes a complementary mating surface in contact with said attachment segment mating surface.

18. The pistol slide of claim 17 wherein said attachment segment mating surface and said plunger complementary mating surface, when in contact, cause said plunger and resilient bias member combination to move in an axial direction parallel to said slide side surface when said slide member is rotated outwards, away from said slide, which provides said restoring force to said slide member.

19. The pistol slide of claim 15 wherein said plunger includes a peg extending radially therefrom for assembling a side member/plunger/resilient bias member combination within said slide, said peg insertable within a slot located within a bottom portion of said attachment segment.

20. A method of assembling a pistol slide having a slide member rotatably attached thereto, said method comprising:

providing an insertion force to a resilient bias member and a plunger within an aperture accessible from a breech end of said pistol slide;

pushing said resilient bias member and said plunger towards a muzzle end of said pistol slide such that said plunger is partially exposed in a receiving slot located on a side surface of said slide;

inserting said slide member in a partially walled aperture accessible from a top surface of said slide top surface, said side surface, or both, and aligning a slot within said slide member with a segment extending radially from said plunger during insertion such that said slide member is fully insertable within said receiving slot when said plunger and said side member segment are aligned; and removing said insertion force, such that said resilient bias member provides a restoring force to said plunger.

* * * * *